US009492356B2

(12) United States Patent
Balakier et al.

(10) Patent No.: US 9,492,356 B2
(45) Date of Patent: Nov. 15, 2016

(54) CONTAINER WITH A DISPENSING SCHEDULE

(71) Applicant: RedCap, LLC, Marblehead, MA (US)

(72) Inventors: Alfred Richard Balakier, Kirkland, WA (US); Daniel Albert Gosselin, Gloucester, MA (US)

(73) Assignee: RedCap, LLC, Marblehead, MA (US)

( * ) Notice: Subject to any disclaimer, the term of this patent is extended or adjusted under 35 U.S.C. 154(b) by 183 days.

(21) Appl. No.: 14/275,661

(22) Filed: May 12, 2014

(65) Prior Publication Data

US 2014/0332494 A1 Nov. 13, 2014

Related U.S. Application Data

(60) Provisional application No. 61/822,214, filed on May 10, 2013.

(51) Int. Cl.
*A61J 7/04* (2006.01)

(52) U.S. Cl.
CPC ..... *A61J 7/04* (2013.01)

(58) Field of Classification Search
CPC .. A61J 7/04; B65D 2583/0409; G06M 1/24; G06M 1/248; G06F 11/23
USPC ..... 116/308, 309, 310, 311, 312, 313, 314, 116/315; 206/459.1, 534; 215/230
See application file for complete search history.

(56) References Cited

U.S. PATENT DOCUMENTS

| | | | | |
|---|---|---|---|---|
| 4,365,722 | A * | 12/1982 | Kramer | A61J 7/04 116/308 |
| 4,782,966 | A * | 11/1988 | Thackrey | B65D 50/043 116/308 |
| 5,261,548 | A * | 11/1993 | Barker | A61J 7/02 206/534 |
| RE34,930 | E * | 5/1995 | Kusz | A61J 7/04 116/308 |
| 5,638,970 | A * | 6/1997 | Garby | A61J 7/04 116/308 |
| 5,803,283 | A * | 9/1998 | Barker | A61J 7/02 116/308 |
| 6,779,480 | B2 | 8/2004 | Zamjahn | |
| 6,845,064 | B2 | 1/2005 | Hildebrandt | |
| 2005/0029154 | A1 | 2/2005 | Kahn et al. | |
| 2008/0060969 | A1 | 3/2008 | McNeely | |
| 2011/0284415 | A1 | 11/2011 | Balakier et al. | |

* cited by examiner

*Primary Examiner* — R. Alexander Smith
(74) *Attorney, Agent, or Firm* — Olympic Patent Works PLLC

(57) ABSTRACT

The current disclosure is directed to a container with a dispensing schedule. In one implementation, the container with a dispensing schedule comprises a bottle with a threaded neck and a complementarily threaded cap having a cylindrical rim and an internal schedule display. An indication on or within the internal schedule display is displayed through an aperture in the cap rim. Features included in the cap and schedule display interoperate to ensure that the displayed indication is advanced when the cap is removed from, and subsequently threaded onto, the bottle container. The displayed indication is relatively large and clear, to facilitate viewing by vision-impaired users, and the indication-advancement mechanism is robust and reliable. In addition, the cap and internal schedule display include features that allow the displayed indication to be set to a particular indication.

9 Claims, 11 Drawing Sheets

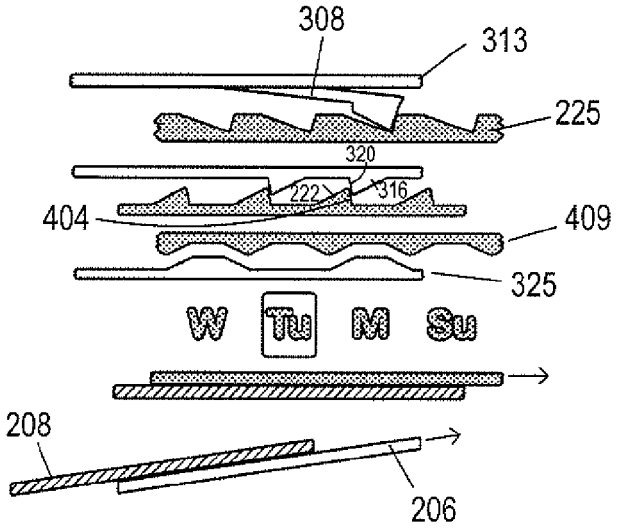
FIG. 7G
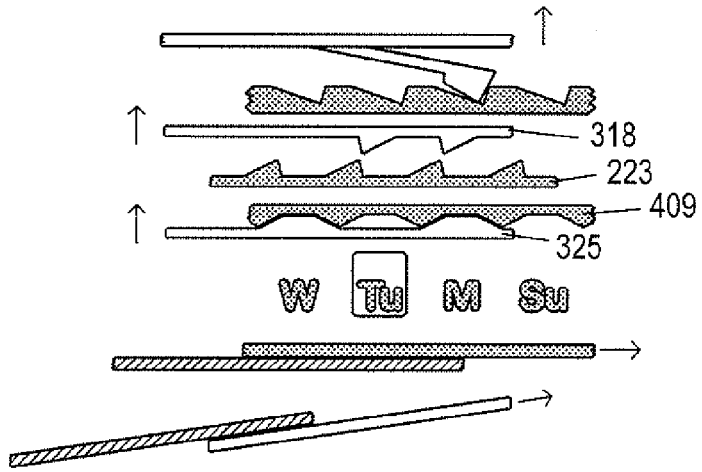
FIG. 7H
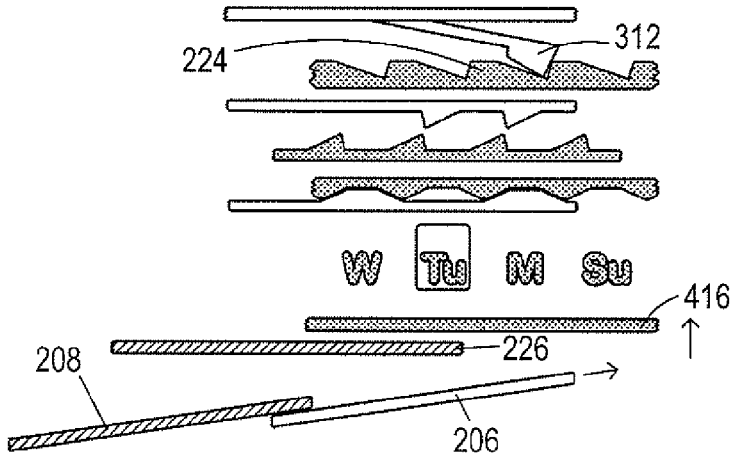
FIG. 7-I

CONTAINER WITH A DISPENSING SCHEDULE

CROSS-REFERENCE

This application claims the benefit of Provisional Patent Application No. 61/822,214, filed May 10, 2013.

TECHNICAL FIELD

The current disclosure is related to various types of containers, including pill bottles, and, in particular, to a container with a dispensing schedule that indicates when the contents within the container should next be accessed.

BACKGROUND

Failure to adhere to a prescribed medication-dosage regimen is a dangerous and ubiquitous problem. Missing a prescribed dosage of certain medications, such as blood-pressure medicine, may result in significant harm and even death. Accidental overdose of prescription medication often causes negative effects that are even more dangerous and immediate than missing a prescribed dosage.

According to the National Council on Patient Information, up to 60% of all prescribed medication is taken incorrectly. Physicians take only 75% of prescribed pills correctly. Non-compliance costs more than $300 billion a year in the USA, accounts for 13% of all hospital admissions, and causes 300,000 deaths.

In addition to prescribed medication, there are vitamins and other supplements that do not require a prescription from a doctor and that are also recommended for use according to a regular schedule. Failure to adhere to a recommended schedule may lessen the effectiveness of the vitamins and other supplements and may exposes a consumer to the risk of overdose. Pills prescribed by veterinarians for the care of animals are associated with similar risks and consequences when not used according to a prescribed dosing schedule.

Trying to determine whether or not a particular dose has already been taken or administered is, for many, an even more difficult aspect of adhering to a recommended administration schedule than remembering the times of scheduled doses. The repetitive nature of consuming pills on a daily basis can lead to confusion with regard to whether or not a particular dose that were scheduled for administration have, in fact, been administered.

Many different medicine dispensers and medicine-dispensing regimes have been proposed and developed in order to assist consumers in self-administration of drugs, vitamins, and other consumables. However, the fact that, according to current statistics, non-compliance with administration schedules continues to be a serious problem and represents a significant financial burden to consumers as well as to society, as a whole, indicates that the many proposed and currently-available regimes and dispensers have not effectively addressed problems associated with self-administration of pills by consumers.

Many medications, vitamins, and supplements are currently distributed in threaded bottles. Most often, these threaded bottles are blow-molded. Unlike injection molded bottles, a blow-molded bottle can be readily manufactured to have a neck portion smaller in diameter than the diameter of the main portion of the bottle. Blow-molded bottles can be easily scaled to have larger volumes without proportionally increasing cap sizes. Blow-molded bottles can be manufactured to have different volumes, shapes, and sizes that share a commonly sized neck and thus a commonly sized cap. Blow-molded, threaded bottles are mass-produced at low cost. A significant portion of existing manufacturing facilitates and automated dispensing systems are configured to produce and use threaded bottles.

SUMMARY

The current disclosure is directed to a container with a dispensing schedule. In one implementation, the container with a dispensing schedule comprises a bottle with a threaded neck and a complementarily threaded cap having a cylindrical rim and an internal schedule display. An indication on or within the internal schedule display is displayed through an aperture in the cap rim. Features included in the cap and schedule display interoperate to ensure that the displayed indication is advanced when the cap is removed from, and subsequently threaded onto, the bottle container. The displayed indication is relatively large and clear, to facilitate viewing by vision-impaired users, and the indication-advancement mechanism is robust and reliable. In addition, the cap and internal schedule display include features that allow the displayed indication to be set to a particular indication.

BRIEF DESCRIPTION OF THE DRAWINGS

FIGS. 7A-I provide unwrapped views of the cap, schedule-display, and bottle components of the CDS that illustrate step-by-step interaction of these components as the cap is screwed onto, and removed from, the CDS bottle.

DETAILED DESCRIPTION

Figure 1:
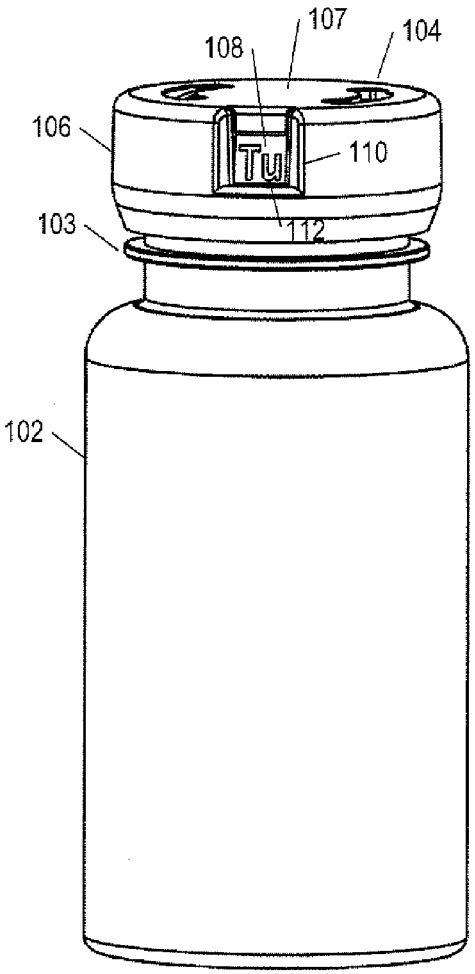
FIG. 1 shows a perspective view of a first implementation of the container with a dispensing schedule ("CDS") to which the current disclosure is directed.

FIG. 1 shows a perspective view of a first implementation of the container with a dispensing schedule to which the current disclosure is directed. The illustrated implementation of the container with a dispensing schedule ("CDS") includes an approximately cylindrically shaped bottle 102 with a threaded neck 103 and a complementarily threaded cap assembly 104. The cap assembly 104 includes a cylindrical rim 106, a disk-shaped top 107, cap threading, not shown in FIG. 1, that is complementary to the bottle threads, and an internal schedule display, a portion 108 of which is visible through an indication-display aperture 110 in the cylindrical rim. A single indication 112, printed, attached, or otherwise included in the visible portion 108 of the schedule display, is aligned with the indication-display aperture for display to a user. In the example CDS implementation shown in FIG. 1, the currently displayed indication 112, "Tu," indicates to a user that a next dose is scheduled to be administered on Tuesday.

Interior features of the cap and internal schedule display interoperate with one another and with bottle features to ensure that the displayed indication is correctly advanced by one indication along the sequence of indications contained within a circular sequence of indications when the cap is removed and re-affixed to the bottle. The displayed indication is not advanced unless the cap is successfully removed and replaced or the displayed indication is deliberately and manually advanced using manual-advancement features, as discussed further, below. The displayed indication is displayed through the indication-display aperture in the cap rim, ensuring that there is adequate available surface area on which to provide a clear and easily read indication. The indication may be alternatively displayed from the top of the cap, in alternative CDS implementations. Note that the particular form of the indication for when a next dose is to be administered or self-administered may vary with different CDS implementations. In certain CDS implementations, the schedule element may display an indication of the time of day, for example, "am," or may display a particular hour of day. In other CDS implementations, the schedule element may display precise date and/or time information. The internal schedule display may include an essentially arbitrary number of different elements, or indications. In the example CDS implementation shown in FIG. 1, the internal schedule display includes fourteen schedule elements that include two cycles of each day of a week.

The CDS implementation shown in FIG. 1 can be inexpensively manufactured from commonly used polymeric materials. When manufactured according to currently-available precision, interoperating components in the cap assembly provide for reliable advancement of the displayed indication by one position within an ordered set of indications included on, or within, schedule-display elements arranged on an outer rim of the schedule display only when the cap assembly is successfully removed and reaffixed to the bottle. CDS implementations are designed for rapid, reliable, and cost-efficient manufacturing. The indication-advancement mechanism in the cap assembly is designed to function effectively with common threaded bottles that have a narrow neck portion with a relatively shallow thread pitch. The mechanism is robust and versatile, and is easily scaled to accommodate threaded bottles with various different neck sizes and thread designs. The CDS implementation is designed to incorporate conventional threaded bottles, or conventional threaded bottles include threaded bottles currently used for storing medicines, vitamins, and other supplements. A significant constraint for cost-effective manufacturing is the need to minimize the number of components. The CDS implementation shown in FIG. 1 has three single-piece components, for example, which represents a relatively small number of components that can be efficiently and cost-effectively mass produced and assembled. A single-piece component is a component that can be directly manufactured, without subsequent assembly from multiple subcomponents, such as a plastic object that is injection molded or a stamped, continuous metal object. Each additional component adds time, cost, and complexity to manufacturing and assembling of the CDS, which is why the number-of-components constraint is significant. The CDS implementation shown in FIG. 1 also, like the remaining CDS implementations discussed in this document, compatible with foil seals used for tamper-resistant and packaging and for isolating the contents of the bottle from air-exchange and, particularly, water-vapor exchange with the environment. The CDS implementations discussed in the current document also provide an aesthetically pleasing click or other physical indication of indication advancement, can be used both for single-thread and multi-thread bottle threading, including a threading with a thread pitch of less than 2.5 degrees, a thread pitch of less than 5 degrees, a thread pitch of less than 10 degrees, a thread pitch of between 1.5 and 2 degrees, a thread pitch of between 2.0 and 2.5 degrees, a thread pitch of between 2.5 and 3 degrees, a thread pitch of between 3 and 4 degrees, and a thread pitch of between 4 and 5 degrees, and can continued to be used over an arbitrary number of dispensing-schedule cycles, since indication advancement is precise.

Figure 2:
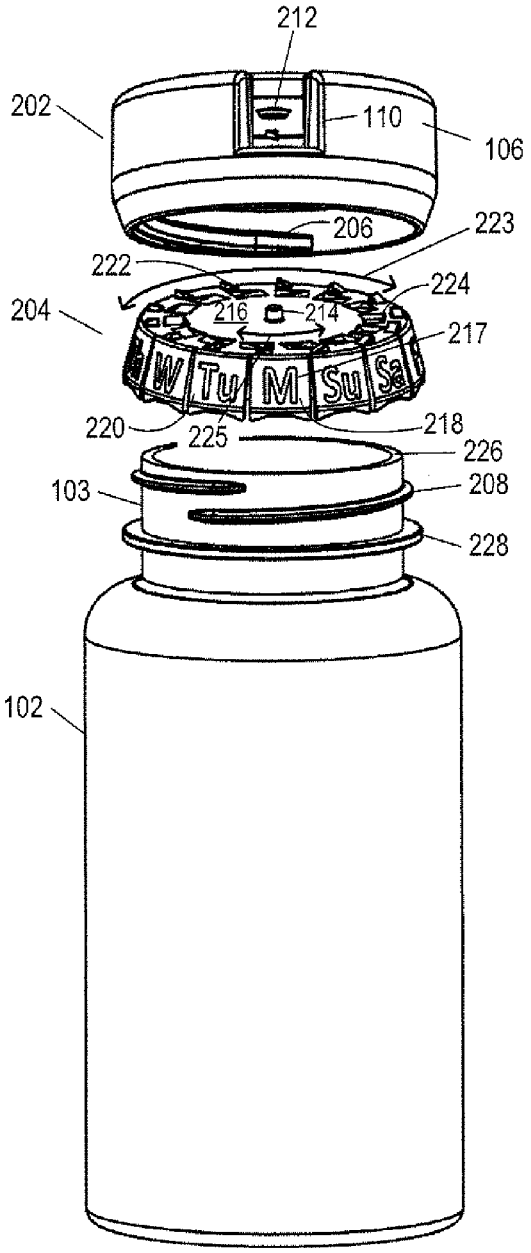
FIG. 2 shows an exploded perspective of the CDS implementation shown in FIG. 1.

FIG. 2 shows an exploded perspective of the CDS implementation shown in FIG. 1. In the exploded view, three components of the CDS shown in FIG. 1 are visible, as are additional features of the three components. The cap 202 is shown removed from, and above, the internal schedule display 204. The cap 202 has internal cap threading 206 that allows the cap 202 to be screwed onto the bottle 102 by engaging with external threading 208 on the neck 103 of the bottle 102. A schedule-display-centering feature 212, located at the center of the bottom of the disk-shaped cap top, engages with a centering pin 214 on the top disk-shaped surface 216 of the schedule display 204 when the schedule display 204 is assembled with the cap 202 to ensure that the schedule display 204 stays centered within the cap assembly (104 in FIG. 1) and provides for transfer of force, applied to the cap, to the center of the schedule display. The schedule display 204 includes 14 schedule elements, each containing an indication, such as the indication "M" 217 on schedule element 218. The 14 schedule elements are arranged along the external surface of the schedule-display rim 220, or display surface, of schedule display 204. The schedule display 204 includes 14 schedule-display catch teeth, including schedule-display catch tooth 222, uniformly spaced along the perimeter of the top of the disk-shaped surface 216 of the schedule display to form a circular sequence of schedule-display catch teeth 223. The schedule display also contains 14 biasing catches, including biasing catch 224, uniformly spaced and positioned with respect to the 14 catch teeth to form a circular sequence of schedule-display biasing catches 225 concentric with the circular sequence of schedule-display catch teeth 223. In addition to the bottle threading 208, the bottle 102 includes lip 226 and stop annulus 228. The neck portion 103 of the bottle 102 is generally smaller than the body portion of the bottle.

Figure 3B:
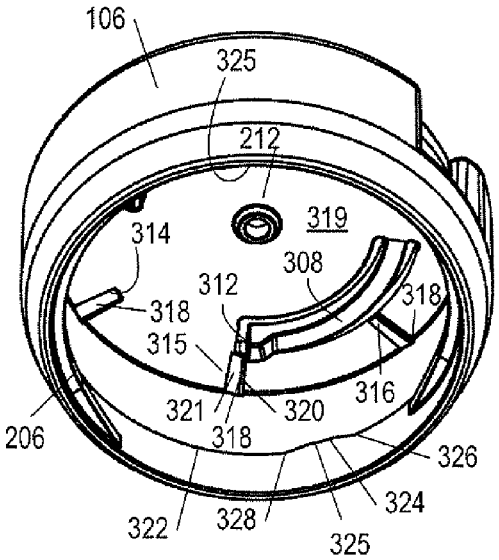
FIGS. 3A-C show alternative perspective views of the cap of the CDS implementation shown in FIG. 1.
Figure 3A:
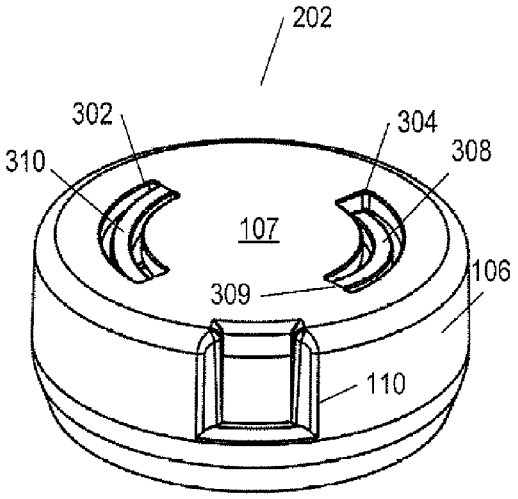
Figure 3C:
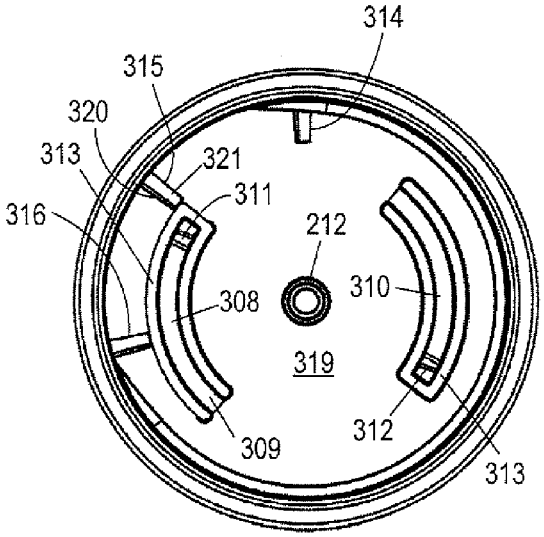

FIGS. 3A-C show alternative perspective views of the cap of the CDS implementation shown in FIG. 1. In FIG. 3A, the cap 202 is viewed from above. In FIGS. 3B-C, the cap 202 is viewed from below. Two arc-shaped grooves 302 and 304 are formed on the top surface 107 of the disk-shaped cap 202. As seen in FIGS. 3B-C, two flexible pressing springs 308 and 310 are centered within arc-shaped grooves 304 and 302, respectively. Each flexible pressing spring, for example pressing spring 308, is attached, at a first end, to the cap at one end of a groove. Pressing spring 308 is attached to the cap top at end 309 of groove 304. Each pressing spring has a biasing feature at a second end opposite from the first end, such as biasing feature 311 at the second end of pressing spring 308. The pressing springs extend downward, form their first ends, towards the top surface of the schedule display in the assembled cap assembly. The biasing features 311 and 312 are complementary to the schedule-display biasing catches of the circular set of schedule-display biasing catches 225 shown in FIG. 2. The biasing features 311 and 312 form a set of biasing features 313. In the CDS implementation shown in FIGS. 1-3, there are three cap catch teeth 314-316 that protrude from the bottom surface 319 of the disk-shaped cap 202. Each cap catch tooth, for example catch tooth 315, further includes an engaging side and a tapered side, such as engaging side 320 and tapered side 321 of catch tooth 315. The cap catch teeth together comprise a set of cap catch teeth 318. The cap catch teeth engage, during cap-removal and cap-replacement operations, schedule-display catch teeth of the circular set of schedule-display catch teeth 223 shown in FIG. 2. An annular support 322 on the inner surface of the cap rim 106 supports the schedule display 204 and secures the schedule display 204 within the cap following insertion of the schedule display 204 into the cap 202. In the CDS implementation shown in FIGS. 1-3, the annular support 322 includes two double-ramp features spaced 180 degrees apart, including cap double-ramp feature 324, which extend upward along the inner surface of the cap rim 106. The cap double-ramp features comprise a set of cap double-ramp features 325. Each cap double-ramp feature includes a leading ramp and a trailing ramp, such as leading ramp 326 and trailing ramp 328 of cap double-ramp feature 324. However, in alternative CDS implementations, the number and positions of cap double-ramp features 324 may be altered and, in addition, these features may include only a single ramp or alternative shapes. These various cap features interoperate with schedule-display features, described below, to provide for reliable element-by-element and indication-by-indication advancement of the schedule display with each successful removal and replacement of the cap as well as provide child-resistant locking of the cap to the bottle.

Figure 4A:
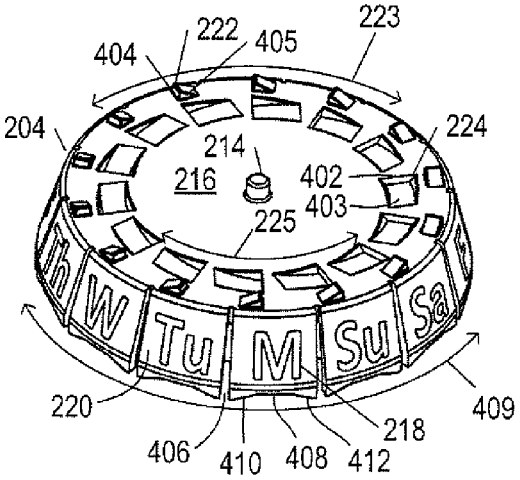
FIGS. 4A-B show alternative perspective views of the schedule display of the CDS implementation shown in FIG. 1.
Figure 4B:
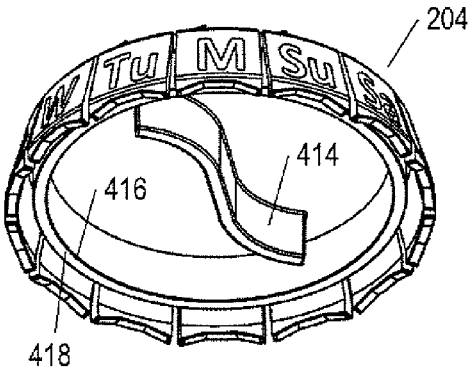

FIGS. 4A-B show alternative perspective views of the schedule display of the CDS implementation shown in FIG. 1. In FIG. 4A, the schedule display 204 is viewed from above. In FIG. 4B, the schedule display 204 is viewed from below. Each schedule-display biasing catch of the set of schedule-display biasing catches 225 includes an engaging side and a tapered side, such as engaging side 402 and a tapered side 403 of schedule-display biasing catch 224. The schedule-display biasing catches engage with cap biasing features 311 and 312 at the second ends of the pressing springs 308 and 310. Each schedule-display catch tooth of the circular set of schedule-display catch teeth 223, such as schedule-display catch tooth 222, includes an engaging side that engages with the engaging side of a cap catch tooth as well as a tapered side, such as engaging side 404 that engages with cap-catch-tooth engaging side 320 in FIG. 3B and tapered side 405. In the illustrated implementation, there are 14 schedule elements positioned uniformly along the outer circumference of the schedule display 204, each schedule element including a day-of the-week indication. Each schedule element is spatially separated from its adjacent schedule elements by a slit, for example, slit 406, which allows the rim 220 to compress in order to facilitate insertion of the schedule display 204 into the cap 202. Each schedule element, for example schedule element 218, has an inverted double-ramp feature along the bottom edge of the schedule element, such as inverted double-ramp feature 408 along the bottom edge of the schedule element 218. The schedule-display inverted double-ramp feature 408 includes a leading ramp 410 and a trailing ramp 412. The schedule-display inverted double-ramp features form a circular set of schedule-display inverted double-ramp features 409. As discussed below, the schedule-display inverted double-ramp features 409 interoperate with the cap double-ramp features (325 in FIG. 3B) in order to facilitate advancement of the schedule display upon successful removal from, and replacement of the cap onto, the bottle. The schedule display 204 includes a grip 414 that can be manually engaged. The grip 414 allows for initial positioning of a particular schedule element within the display aperture (110 in FIG. 1) of the cap rim to provide an initial administration-time indication for administration of a first dose. The grip 414 may be one or more raised tabs as well as a variety of protrusions, indentations, or holes that can provide a similar schedule-display-positioning function in alternative CDS implementations. These features can either be part of, or connected to, the lower disk-shaped surface of the schedule display, the inner side of the rim of the schedule display, or connected to both. The schedule display 204 includes a sealing ring 416 along the inner surface of the schedule display, a lower edge 418 of which rests against the bottle lip (226 in FIG. 2) to provide an airtight, gasket-like seal between the bottle and the cap assembly when the cap assembly is screwed onto the bottle.

Figure 5:
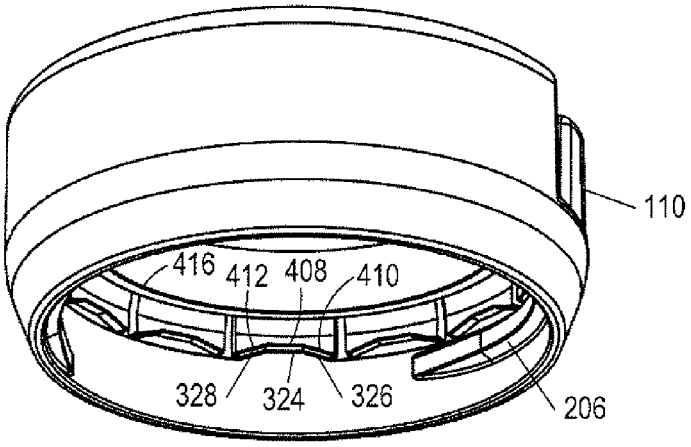
FIG. 5 shows a perspective view of the cap assembly of the CDS implementation shown in FIG. 1.

FIG. 5 shows a perspective view of the cap assembly of the CDS implementation shown in FIG. 1. In FIG. 5, the schedule display 204 is shown inserted into the cap 202 to produce a fully assembled cap assembly. Note that the schedule display is inserted into the cap past the annular support that holds the schedule display 204 within the cap 202. The schedule display 204 and the cap 202 are partially engaged once inserted into the cap 202. The pressing springs (308 and 310 in FIG. 3) force the schedule display 204 downward so that the schedule-display inverted double-ramp features 409 and the cap double-ramp features 325 along the annular support 322 are meshed together, fixing the position of the schedule display with respect to the cap. In FIG. 5, the leading ramp 410 and the trailing ramp 412 of the schedule-display inverted double-ramp feature 408 engage with the leading ramp 326 and the trailing ramp 328 of the cap double-ramp feature 324, respectively. Note also that the schedule display is rotatably mounted within the cap when the cap assembly is not screwed onto the bottle. Therefore, the partial engagement between the schedule display and the cap prevents the schedule display from freely rotating within the cap, but allows the schedule display to be manually rotated in order to select a particular schedule element for display through the cap aperture 110 by applying a rotational force to grip 414 in FIG. 4B. As discussed below, when the cap assembly is screwed onto the bottle, features of the cap assembly, discussed below, apply pressure to fully mesh the schedule-display catch teeth together with the cap catch teeth to prevent rotation of the schedule display with respect to the cap.

Figure 6:
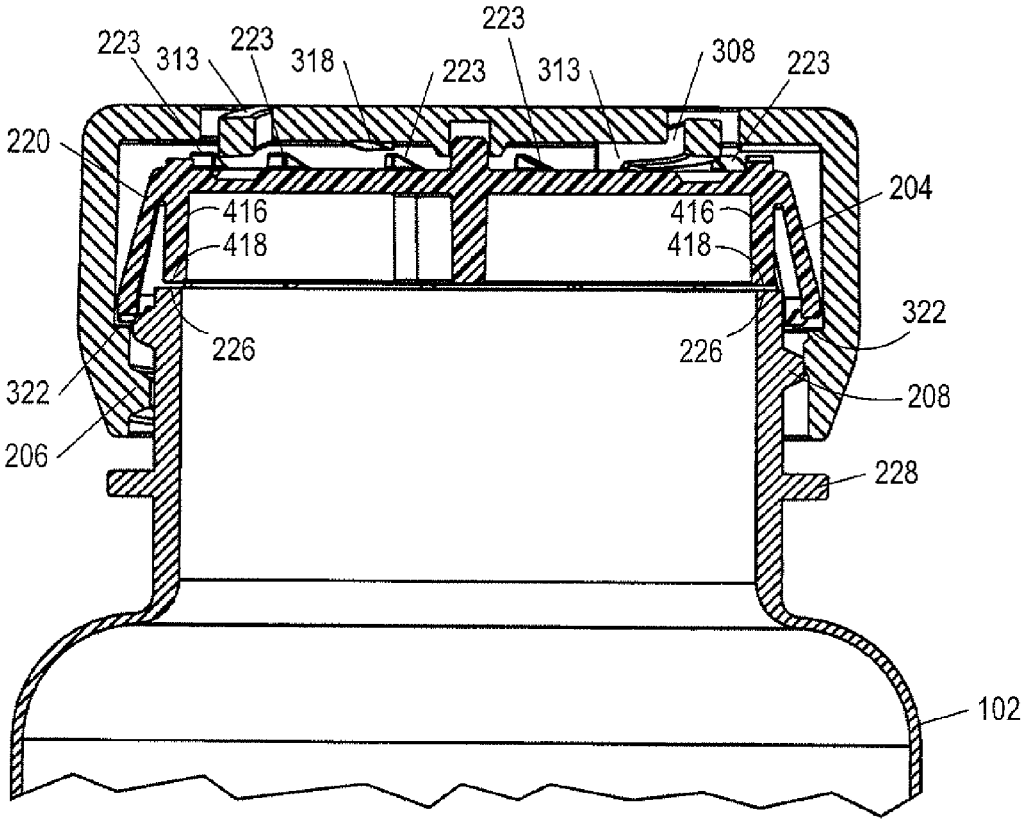
FIG. 6 shows a cross-section of a portion of the CDS implementation shown in FIG. 1.

FIG. 6 shows a cross-section of a portion of the CDS implementation shown in FIG. 1. The cross-sectional view shown in FIG. 6 illustrates the CDS implementation when the cap assembly is placed onto the bottle but not yet fully screwed onto, and as yet only slightly engaged with, the bottle. In the cross-sectional view, the schedule display 204 rests on the annular support 322 of the inner surface of the cap rim. The sealing ring 416 of the schedule display 204 engages with the bottle lip 226, which provides an airtight sealing between the bottle and the cap assembly once the cap assembly is screwed onto the bottle. Cap threading 206 is engaged with the bottle threading 208. Cap catch teeth 318 are in vertical alignment with schedule-display catch teeth 223 but do not make contact. Cap biasing features 313 are in lateral alignment and make contact with the complementary schedule-display biasing catches 225 in FIG. 2.

FIGS. 7A-I provide unwrapped views of the cap, schedule-display, and bottle components of the CDS that illustrate step-by-step interaction of these components as the cap is screwed onto, and removed from, the CDS bottle. In FIGS. 7A-I, interactions between six different pairs of features are shown, next identified with respect to FIG. 7A. A first pair of features 702 includes: (1) the pressing-spring/biasing features, such as pressing-spring/biasing feature 312, of the cap 202; and (2) the schedule-display biasing catches of the circular set of schedule-display biasing catches 225. A second pair of features 704 includes: (1) the cap catch teeth, such cap catch tooth 316; and (2) schedule-display catch teeth of the circular set of schedule-display catch teeth 223. A third pair of features 706 includes: (1) schedule-display inverted double-ramp features of the circular set of schedule-display inverted double-ramp features 409; and (2) cap double-ramp features of the set of cap double-ramp features 325. A fourth pair of features 708 includes: (1) the indication-display aperture 110 in the cylindrical rim of the cap 202; and (2) the indication-containing display-schedule elements, such as display-schedule element 218. A fifth pair of features 710 includes: (1) the sealing ring 416 of the schedule display 204; and (2) the bottle lip 226. A sixth pair of features 712 includes: (1) bottle threading 208; and (2) cap threading 206. In FIGS. 7A-I, different types of cross-hatching are used to distinguish the two features and/or components of each feature pair. Also, in FIGS. 7B-7D and 7F-7I, small arrows, such as small arrow 713, are used to indicate relative motion of one element of a pair of features with respect to the other feature of the pair of features.

Figure 7A:
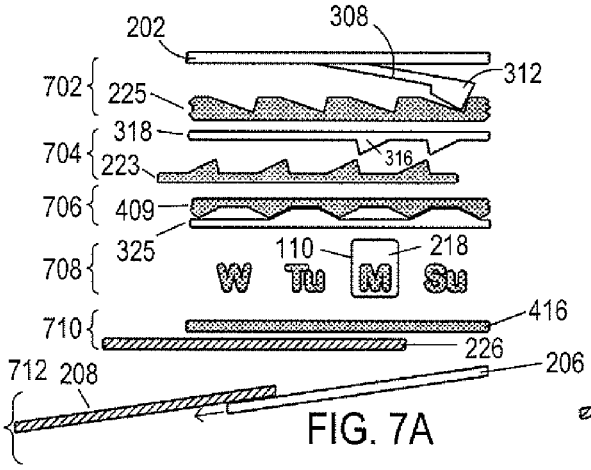

FIGS. 7A-F illustrate the process of affixing the cap assembly to the bottle and the interaction of the various features and components during this process. As shown in FIG. 7A, prior to screwing the cap assembly onto the bottle, as shown in FIG. 6, the cap double-ramp features 325 and the schedule-display inverted double-ramp features 409 are meshed together, fixing the position of the schedule display with respect to the cap. As discussed above, the pressing springs (308 and 310 in FIG. 3) apply pressure downward on the schedule display to ensure this meshing of double-ramp features with inverted double-ramp features. The cap biasing features, such as cap biasing feature 312, are aligned and engaged with schedule-display biasing catches 225. Schedule-display catch teeth 223 are aligned but disengaged with cap catch teeth 318.

When the cap assembly is placed onto the bottle and rotationally adjusted as the cap assembly is forced down, cap threading 206 of the cap starts traveling along the bottle threading 208. As shown in FIG. 7B, when the cap assembly is rotated in a clockwise direction, the schedule-display sealing ring 416 comes into contact with the bottle lip 226.

Figure 7D:
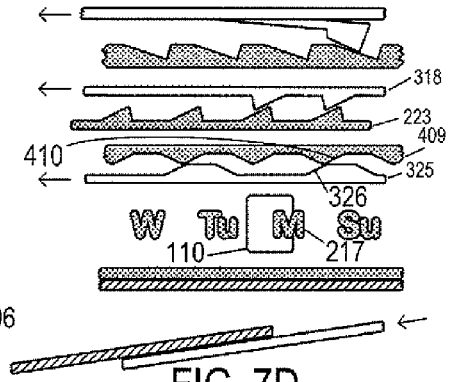
Figure 7B:
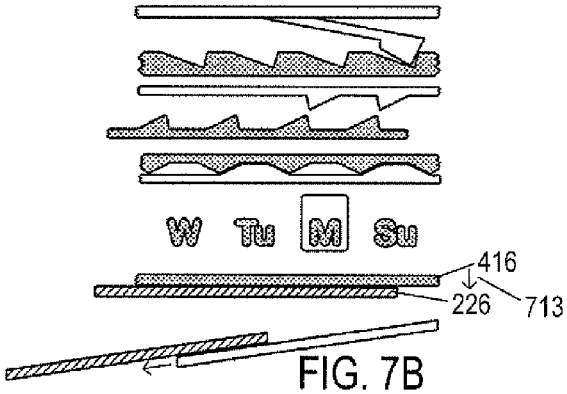
Figure 7E:
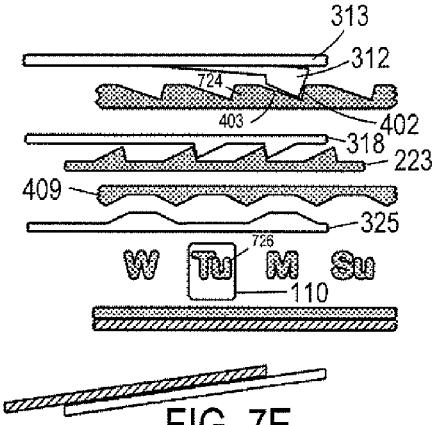
Figure 7C:
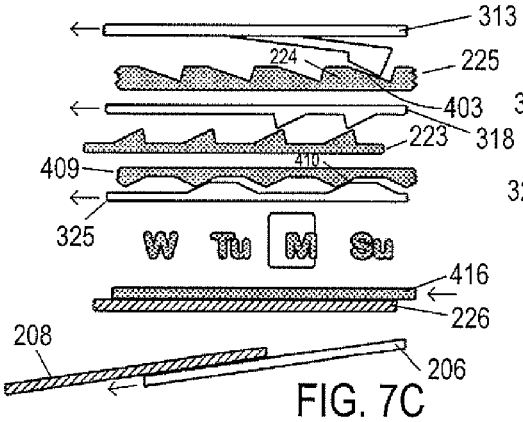

As shown in FIG. 7C, as the cap assembly continues to be rotated in a clockwise direction, the engagement between the schedule-display sealing ring 416 and the bottle lip 226 prevents the schedule display from descending further as the cap continues to descend along the bottle threading. The rotation of the schedule display around the bottle is hindered by interaction of the schedule display sealing ring 416 and the bottle lip 226, while the cap continues to rotate about the bottle, moving the aperture in the rotation direction relative to the schedule display and beginning advancement of the displayed indication. A downward force applied to the cap is primarily transferred from the cap 202 to the schedule display 204 through the centering feature 212 and centering pin 214. Because any rotational component of the transferred force is applied at the center of the axis of rotation, where the mechanical advantage with respect to inducing rotation is quite low, the rotational component of the transferred force cannot overcome the friction-induced resistance to rotation arising from the interaction between the schedule display 204 and bottle 102 at the interface between the sealing rim 416 and bottle lip.

As the cap threading follows the path of the bottle threading 208, the cap continues to descend along the bottle neck. The descent of the cap in the vertical direction allows the leading ramps of the cap double-ramp features 325 to travel along the descending paths of the leading ramps of the schedule-display inverted double-ramp features 409 so that the cap advances relative to the schedule-display and the schedule display inverted double-ramp features 409 and the cap double-ramp features 325 begin to slide out of engagement with each other. The slope of the leading ramps, such as leading ramp 410, is greater than the slope of the bottle threading, which has a relatively small pitch angle, often between two to three degrees. Thus, the cap needs to rotate, about the container axis of symmetry, over a greater rotational angle with respect to the bottle lip than the angle it needs to rotate with respect to the schedule display to achieve the vertical descent needed to release the double ramp features from the reverse double ramp features. As a result, despite friction between the schedule display and bottle, until the double ramp features are released, the cap forces the schedule display to rotate with respect to the container, the difference between these two angles. The angle of rotation of the cap with respect to the bottle is therefore greater than the angle of rotation of the schedule display with respect to the bottle, allowing the cap to slip ahead of the schedule display.

This, in turn, provides for advancement of the displayed indication, on a schedule element of the schedule display, with respect to the indication-display aperture (110 in FIG. 1). The result of the continued but attenuated rotation of the schedule display is that a user rotates the cap further with respect to the bottle than with respect to the schedule-display, advancing the indication-display aperture to the next schedule element. Thus, the shallow thread pitch on threaded bottles is compensated for by the interoperation of the double-ramp features of the cap and the inverted double-ramp features of the schedule display, providing sufficient vertical drop between the cap and the schedule display during rotation from one schedule element to the next for different types of cap assemblies with different numbers of schedule elements to function properly. Relatively little friction is created by the rotation of the cap with respect to the schedule display, as a result of which the cap screws onto the bottle smoothly during the indication-advancement process while rotation of the cap with respect to the schedule display increases as the rotation of the schedule display with respect to the bottle slows and finally stops.

As shown in FIG. 7C, the tips of the cap catch teeth 318 rotate past the tips of the schedule-display catch teeth 223, and cap 202 is drawn further downward relative to schedule display 204 as the tips of the cap catch teeth slip below the tips of the schedule-display catch teeth. The cap biasing features 313 start to slide out and away from the schedule-display biasing catches 225 along the tapered sides of the biasing catches, such as tapered side 403 of biasing catch 224.

In FIG. 7D, as the cap 202 continues to rotate with respect to the bottle and schedule display 204, indication-display aperture 110 advances further in a clockwise direction with respect to the "M" indication 217. The tapered sides of the cap catch teeth of the set of cap catch teeth 318 descend further with respect to the tapered sides of the schedule-display catch teeth 223. The cap double-ramp features 325 are partially released from the schedule-display inverted double-ramp features 409 as the cap leading ramps, such as cap leading ramp 326, slide to the ends of the schedule-display leading ramps, such as schedule-display leading ramp 410. As the cap double-ramp features 325 become fully released from the schedule-display inverted double-ramp features 409, resistance to further rotation of the cap with respect to the schedule display decreases. Therefore, the torque applied to initiate indication advancement is generally sufficient to carry through an indication-advancement cycle, with a next indication displayed through the indication-display aperture 110 at cycle completion, as shown in FIG. 7E. In other words, when a CDS user applies sufficient force to the cap to initiate indication advancement, the cap glides through the remaining portion of the indication-advancement cycle without a need for subsequent application of substantial additional force.

As shown in FIG. 7E, the cap double-ramp features 325 and the schedule-display inverted double-ramp features 409 are disengaged and realigned for future engagement. The cap catch teeth 318 advance forward to again engage with next schedule-display catch teeth 223, preventing further advancement of the cap around the schedule display. Biasing features 313, including biasing feature 312, slip into engagement with next biasing catches, such as biasing catch 724. Indication-display aperture 110 displays a next schedule element having an indication "Tu" 726. The indication-advancement cycle started in FIG. 7A is complete in FIG. 7E. Screwing the cap assembly onto the bottle results in advancement of the displayed schedule element by one element along the sequence of schedule elements disposed along the circumference of the schedule-display rim.

Figure 7F:
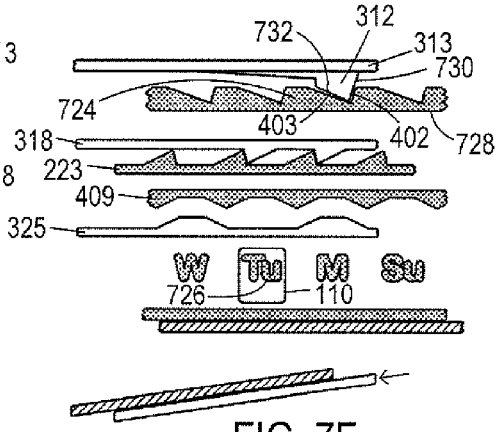

FIG. 7F shows the cap continuing to be rotated in a clockwise direction, further tightening the cap on the bottle following the completion of the indication-advancement cycle in FIG. 7E. The cap catch teeth 318 fully engage with the schedule-advancement display catch teeth 223, compelling the schedule display to rotate with the cap, so that aperture 110 remains centered over indication 726.

Note that, as shown by the configuration of feature pairs in FIG. 7A, when a person attempts, but fails to, properly place cap 202 onto the bottle and the bottle lip 226 and schedule-display sealing ring 416 fail to make contact, the schedule-display inverted double-advancement ramp features 409 and cap double-ramp features 325 are fully meshed, cap biasing features 313 and schedule-display biasing catches 225 are also fully engaged, and cap catch teeth 318 and schedule-display catch teeth 223 do not slip past one other, preventing the cap and indication-display aperture from inadvertently rotating with respect to the schedule display 204 and changing the displayed indication. Therefore, the displayed indication is advanced only when the cap is successfully screwed onto to the bottle. Also note that the indication process finishes before the cap is completely fastened to the bottle, thus ensuring a user rotates the cap far enough to complete the indication process.

Note that, in the CDS implementation shown in FIGS. 1-7, engaging sides, such as engaging side 402, of the schedule-display biasing catches 225 are not perpendicular to the base (728 in FIG. 7F), but rather slightly slanted away from the tapered sides, such as tapered side 403, so that the inside angle between the engaging sides and the base is acute. Because the biasing features 313 and the schedule-display biasing catches 225 are complementary, the engaging sides, such as engaging side 730, of the biasing features, such as biasing feature 312, are slightly slanted towards the tapered sides, such as tapered side 732, of the biasing catches. This slant reduces the rotational distance a cap biasing feature needs to travel in order to slide into a next biasing catch with respect to the fraction of the total rotational distance represented by the internal angle subtended by each biasing catch. As a result, a number of biasing catches equal to the number of schedule elements can be used. Furthermore, the slant also allows a biasing feature to reach a next biasing catch slightly before the indication-display aperture 110 is centered over a next schedule element and before the engaging sides of the cap catch teeth collide with the engaging sides of the schedule-display catch teeth. Alternatively, to achieve the same effect, the rotational position of biasing catches may be adjusted so that the biasing features reach the next sequential biasing catch before the indication-display aperture is centered over a next schedule element. As a result, the example CDS implementation makes exactly one indication every time the cap assembly is screwed onto the bottle despite a range of user and manufacturing variations as well as potential wear from use. The difference in timing between the cap biasing features snapping into place with the schedule-display biasing catches and cap catch teeth snapping into place with schedule-display catch teeth is sufficiently slight so that it is generally imperceptible to users.

FIGS. 7G-I illustrate components and features of the CDS implementation of FIG. 1-7F as the cap is removed from the bottle. As shown in FIG. 7G, to remove a cap, the cap is rotated in a counter-clockwise direction, with the cap threading 206 of the cap traveling along the bottle threading 208 of the bottle. As the cap lifts from the bottle, the cap catch teeth start to lift out of engagement with schedule-display catch teeth, with the engaging side of each cap catch tooth, such as engaging side 320 of cap catch tooth 316, sliding along the engaging side of each schedule-display catch tooth, such as engaging side 404 of schedule-display catch tooth 222. The slanted surface of the engaging sides eliminates frictional forces during vertical separation of the two catch teeth. Cap biasing features 313 push engaging sides of the biasing catches 225, compelling the schedule display 204 to rotate in cooperation with the cap 202. Furthermore, compression created by the pressing springs, such as pressing spring (308 in FIG. 3B), pushes the schedule display downward against the bottle as the cap lifts away from the schedule display and cap double-ramp features of the set of cap double-ramp features 325, to move upward towards the schedule-display inverted double-ramp features 409.

As shown in FIG. 7H, the cap continues to be rotated in the counter-clockwise direction. The cap catch teeth 318 and the schedule-display catch teeth 223 have separated and fully disengaged. The cap double-ramp features 325 and schedule-display inverted double-ramp features 409 have settled back into their original engagement positions. Finally, as shown in FIG. 7I, the internal cap thread 206 is ready to disengage from the external bottle threading 208. Schedule-display sealing ring 416 has lifted from the bottle lip 226. During the sequence of steps shown in FIGS. 7G-I, the schedule display is fixed in rotational position with respect to the cap as a result of intermeshing of the cap biasing features and the schedule-display biasing catches, preventing schedule display from unintentionally advancing.

In the example CDS implementation shown in FIGS. 1-7, the cap biasing features and schedule-display biasing catches form a biasing means in the clockwise direction. This function could also be provided by a variety of mechanisms connecting the top of the schedule display to the bottom of the cap, including ratchet wheels, prongs, pawls, or variety of projections, notches, or grooves on one component and a complementary mechanism on the other. Biasing means may alternatively be established between the outside of schedule display 204 and the inside of cap 202. For example, biasing means can be located along the bottom face of the disk-shaped cap 202 and on the rim 220 of the schedule display 204. Furthermore, the schedule-display biasing catches can have a variety of shapes that provide a side, on each schedule-display biasing catch, to engage cap biasing features, when rotated in one in one direction, and a side along which the cap biasing features can slide, when rotated in the other direction.

One feature of the design of the CDS implementation shown in FIGS. 1-7 is that the display surface of schedule display 204 provides sufficient space to print, imprint, emboss, deboss, or adhere large-characters and large-symbol indications within schedule elements. In alternative CDS implementations, the schedule elements are instead located on the disk-shaped surface 216 of the schedule display and the indication-display aperture is located on the top face 107 of the cap. In yet other CDS implementations, indication-display aperture is replaced with an indicator or arrow which designates or points to an individual schedule element in each allowed position following initial positioning or indication advancement. In certain implementations, the placement of the indicator and schedule elements is swapped so that the schedule elements are on the cap and the indicator is on the schedule display.

Next, a description is provided for attributes of the example CDS implementation shown in FIGS. 1-7 that allow the CDS implementation to advance precisely one schedule element at a time, re-align for each next cycle, work automatically and flawlessly, prevent human error, incur little wear, continue to work with some wear, function when some of the components are manufactured imperfectly, and be calibrated to various numbers of schedule elements. Component proportions, ratios between the numbers of various components and features, and alignment of various components and features contribute to the proper functioning of the example CDS implementation. Components of the example CDS implementation are proportioned to control the degrees of relative rotation between the cap, the schedule display, and the bottle. Therefore the lengths or proportions of various components as well as the spacings of various components are described in terms of the degrees of the central angle of their arc around the central axis of the example CDS implementation rather than as a particular size. The central axis is an imaginary vertical line corresponding to the rotational axis of the example CDS.

In the example CDS implementation shown in FIGS. 1-7, the cap catch teeth are rotationally positioned relative to cap biasing features and schedule-display catch teeth are rotationally positioned relative to schedule-display biasing catches and to the schedule elements so that, when the cap catch teeth are fully meshed with schedule-display catch teeth, as shown in FIG. 7F, cap biasing features are also fully meshed with schedule-display biasing catches and schedule-display inverted double-ramp features are vertically aligned with cap double-ramp features. The alignment and rotational position of schedule-display catch teeth with cap catch teeth, biasing features with biasing catches, and schedule-display inverted double-ramp features with cap double-ramp features determine the number of degrees by which cap rotates around schedule display each time the cap is mounted to bottle.

The indication-display aperture on the cap is rotationally positioned relative to the cap catch teeth and the schedule elements are positioned around the display surface relative to schedule-display catch teeth so that, when the cap is screwed down and indication-display aperture centers over the next sequential schedule element, the cap catch teeth engage. Various components and features are proportioned so that, when the cap advances around schedule display through a predetermined number of mounting cycles, the cap rotates 360 degrees relative to the schedule display and re-centers indication-display aperture over the starting schedule element.

The central angle of the arc between the engaging side of one schedule-display catch tooth and the engaging side of a next sequential schedule-display catch tooth is a unit fraction (a fraction with numerator=1 and denominator=an integer) of 360 degrees. Therefore the cap and indication-display aperture advance a unit fraction of 360 degrees during a cap-mounting cycle. When the cap is removed and replaced a number of times equal to the denominator of the unit fraction of the central angle between one engaging side and the next sequential engaging side of schedule-display catch teeth, the cap advances around schedule display by 360 degrees.

The positions and proportions of schedule-display catch teeth are coordinated with the desired number of schedule elements. Schedule elements are evenly spaced around schedule display in increments of 360 degrees divided by the number of schedule elements. In the example CDS implementation, the schedule-display catch teeth are positioned so that the central angle of the arc from the engaging side of one scheduled-display catch tooth to the engaging side of the next sequential schedule-display catch tooth is equal to 360 degrees divided by the number of schedule elements. Therefore, in each mounting cycle, the indication-display aperture accurately advances from the center of one schedule element to the center of the next schedule element.

In the example CDS implementation, the positions and proportions of schedule-display catch teeth are also coordinated with the spacing and number of biasing catches. The biasing catches of the example CDS implementation are spaced in angular increments around schedule display equal to the angular increment in schedule-display catch teeth. This is also the angle by which the cap rotates around the schedule display during each mounting cycle.

The schedule elements, biasing catches, catch teeth, and inverted double-ramp features of the schedule display are spaced in equal degree increments around schedule display and are therefore also equal in number. With the components so spaced, each of the relevant components of the cap and schedule display rotate into the same relative alignment at the end of each mounting cycle and, as a result, are realigned for the next mounting cycle.

The mechanism utilized by the example CDS implementations to make indication advancements is designed to conform to most common prescription drug and vitamin supplement regimens. Most prescriptions and vitamin supplements specify the consumption of a certain number of pills each day. To help a user adhere to a daily schedule, the CDS generally has one schedule element for each dose and for each day of the week. The number of schedule elements is therefore most often a multiple of seven days of the week.

While the example CDS shown in FIGS. 1-7 includes 14 schedule-display catch-teeth features, 14 biasing-catch features, 14 schedule-element features, and 14 schedule-display inverted double-ramp features, the number of these features may be altered, in alternative CDS implementations, in order to provide for a different number of schedule elements. In these alternative CDS implementations, the ratio of one schedule-display catch tooth to one biasing catch and to one schedule element is preserved in order to facilitate advancement of the displayed schedule element by one element when the cap is unscrewed from, and screwed onto, the bottle. However, in yet additional embodiments, this ratio may also be altered. With 14 schedule-elements disposed along the display surface of schedule display, the schedule-display catch teeth are evenly spaced around the schedule display in increments of one-fourteenth of 360 degrees. Similarly, the angular increment for each schedule-display biasing catch is also one-fourteenth of 360 degrees. Thus, the cap advances one-fourteenth of the way around the schedule display during each mounting cycle.

The interval between each successive cap catch tooth is an integer multiple of the one-fourteenth of 360 degrees. Similarly, the interval between two cap biasing features is also an integer multiple of the one-fourteenth of 360 degrees. The number of cap catch teeth, cap biasing features, and cap double-ramp features may be varied in alternative CDS implementations. The schedule display shown in FIGS. 1-7 has two sequential seven-day schedule-element sequences, with one schedule element for each day of the week. An alternative CDS implementation, calibrated for two doses per day, one for AM and a second for PM for each day of the week, has the same number of biasing features, biasing catches, cap catch teeth, schedule-display catch teeth, cap double-ramp features and schedule-display inverted double-ramp features, and schedule elements.

Another CDS implementation designed for three doses per day has 21 schedule-display catch teeth, 21 biasing catches, 21 schedule elements, and 21 schedule-display inverted double-ramp features. The schedule-display catch teeth are evenly spaced around schedule display in increments of 360 degrees divided by 21. The interval between two successive cap catch teeth 316 is an integer multiple of one-twenty-first of 360 degrees. To conform to schedules that are not correlated to seven days of the week, an alternative CDS implementation may be created with a different number of schedule-display biasing catches, catch teeth, and ramp features. For example, a cap assembly with 6 schedule-display biasing catches, catch teeth, and ramp features can be calibrated to hourly and monthly schedules, since hours of the day and months of the year are both multiples of 6.

Figure 8A:
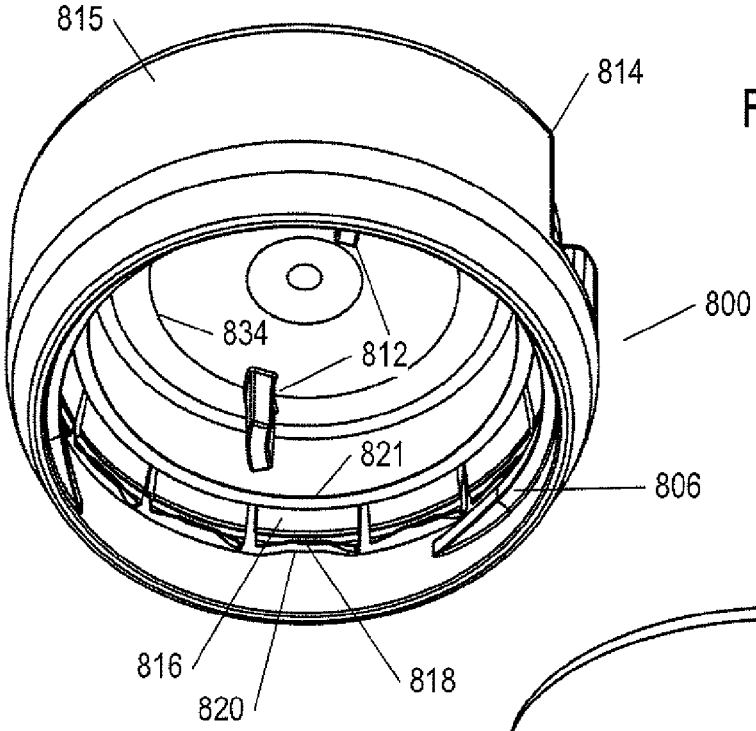
FIG. 8A shows a perspective view of a second CDS implementation of the cap assembly shown in FIGS. 1-7.
Figure 8B:
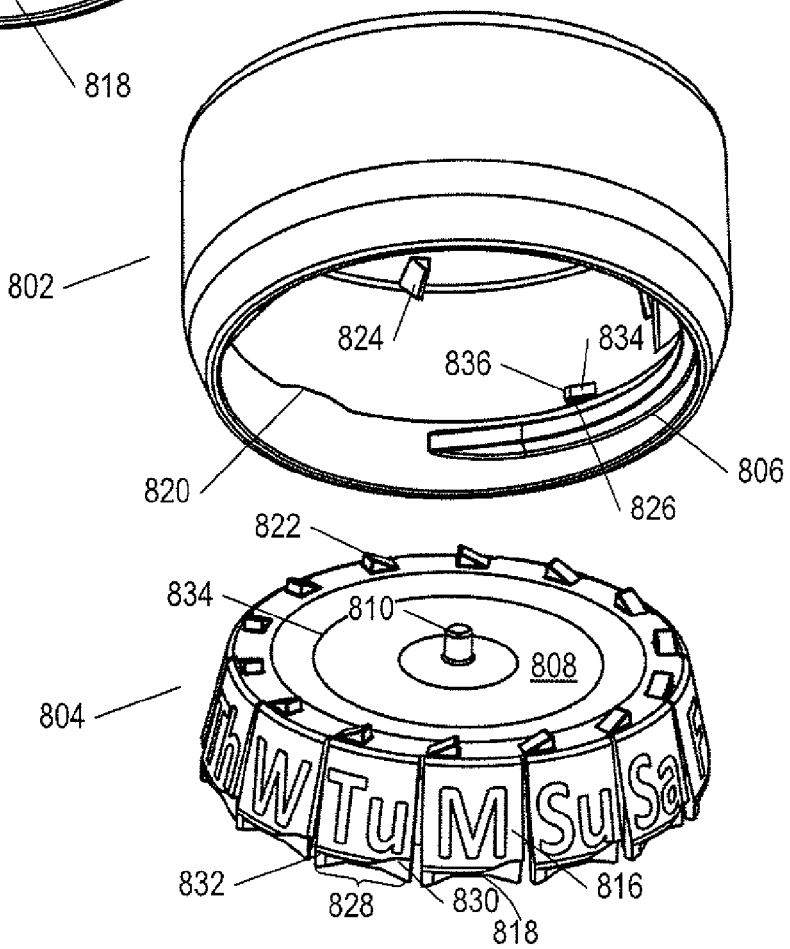
FIG. 8B is an exploded view of the second CDS implementation of the cap assembly shown in FIG. 8A.

FIG. 8A shows a perspective view of a second CDS implementation of the cap assembly shown in FIGS. 1-7. FIG. 8B is an exploded view of the second CDS implementation of the cap assembly shown in FIG. 8A. The second CDS implementation shown in FIGS. 8A-B resembles the CDS implementation shown in FIGS. 1-7. The cap assembly 800 includes cap 802 and schedule display 804 and is compatible with the bottle 102 shown in FIGS. 1-7. In FIG. 8B, the cap 802 is shown disassembled from, and above, the schedule display 804. The cap 802 has threading 806 that allows the cap 802 to be screwed onto a bottle, such as the bottle 102 shown in FIG. 1, by engaging with a bottle threading. A pin 810 centered on the disk-shaped top surface 808 of schedule display 804 engages with a schedule-display-centering feature (similar to schedule-display-centering feature in FIG. 3B) located on the bottom surface of the disk-shaped cap, ensuring that schedule display 804 and cap 802 remain centered when attached. The schedule display 804 also includes a grip 812 that allows for initial positioning of a particular schedule element below an indication-display aperture 814 in the cap rim 815. Flexibility may be added to the cap top surface and the schedule-display top surface 808, for example, by inclusion of ripples on the disk-shaped top surface 808 or forming grip 812 as multiple segments. The surface flexibility may aid in increasing compression between cap 802 and schedule display 804 that is created by rotating cap assembly 800 with respect to the bottle. In FIGS. 8A and 8B, curved line 834 indicates on possible position at which ripples or other features that depart from a planar surface may be located to increase flexibility of the cap and display schedule.

The schedule display 804 shown in the alternative CDS implementation has 14 schedule elements, such as schedule element 816, which contain two seven-day sequences with one schedule element for each day of the week. Each schedule element is spatially separated from its neighboring schedule elements. Each schedule element has an inverted double-ramp feature 818, similar to the schedule-display inverted double-ramp feature 408 in FIG. 4A, at the bottom edge of each schedule element, which interoperates with cap double-ramp feature 820 in order to facilitate advancement of the displayed schedule element during screwing of the cap assembly 800 onto the bottle after sealing ring 821 of the schedule display makes contact with the bottle lip (226 in FIG. 1). The interoperation of the schedule-display inverted double-ramp features and cap double-ramp features during cap-removal and cap-replacement operations is similar to that for the first CDS implementation, described above.

Similar to the schedule display shown in FIGS. 1-7, schedule display 804 also includes 14 schedule-display catch teeth, such as schedule-display catch tooth 822, uniformly spaced along the perimeter of the disk-shaped surface 808 and positioned at a uniform distance with respect to the perimeter of the disk-shaped surface 808. Similar to the cap assembly shown in FIGS. 1-7, when the schedule display 804 and cap 802 rotate with respect to the bottle, cap catch teeth, such as cap catch tooth 824, slide past the schedule-display catch teeth, such as schedule-display catch tooth 822, and move forward to interlock with next schedule-display catch teeth, representing a relative advancement of the schedule-display catch teeth and cap catch teeth by one tooth, preventing further advancement of the cap around the schedule display. The cap catch teeth and schedule-display catch teeth disengage when the cap assembly is removed from the bottle.

In the second CDS implementation shown in FIGS. 8A-B, an alternative biasing mechanism is provided to replace the biasing features 311 and 312 and the schedule-display biasing catches of the circular set of schedule-display biasing catches 225 used in the first CDS implementation. One or more biasing tabs, such as biasing tab 826, are located along the inner circumference of the cap rim 815. One or more biasing catch features are located at the bottom of each schedule element, such as biasing catch feature 828. Each biasing catch feature 828 has a tapered side 830 and an engaging side 832 that are complementary to the tapered side 834 and the engaging side 836 of biasing tab 826, respectively. In the CDS implementation shown in FIGS. 8A-B, biasing tabs, such as biasing tab 826, are wedge-shaped projections. However, a variety of shapes that provide a side to engage biasing catch features in one direction and a side to slide over the tapered side of the biasing catch features in the other direction can be used. As cap 802 rotates around schedule display 804 to move from one schedule-element to the next, as described with reference to the example CDS of FIGS. 7A-F, the tapered side 834 of biasing tab 826 slides along the tapered side 830 of biasing catch feature 828. Schedule element 816 slightly bends to allow biasing tab 826 to slide past the engaging side 832 of biasing catch feature 828. Next, biasing tab 826 slips into a next sequential biasing catch feature as indication-display aperture 814 is centered over a next schedule element. When the cap 802 is rotated counter-clockwise for removal, the engaging side 836 of cap biasing tab 826 pushes the engaging side 832 of biasing catch feature 828, compelling the schedule display 804 to rotate together with the cap 802 so that indication-display aperture 814 remains centered over the next schedule element.

It should be noted that dimensions and positions of various components and features, ratios between the numbers of various components and features, and alignment of various components and features are similar to those previously described in the first CDS implementation. The second CDS implementation shown in FIGS. 8A-B provides an alternative biasing means for replacing the biasing features and biasing catches used in the first CDS implementation.

Figure 9B:
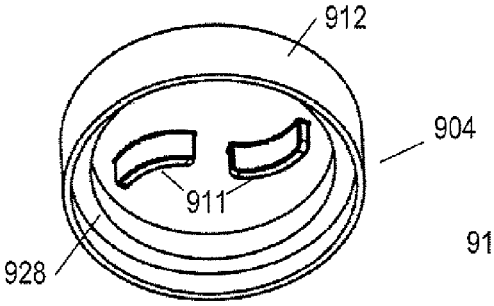
FIG. 9B shows a perspective view of the schedule display of the third CDS implementation shown in FIG. 9A.
Figure 9A:
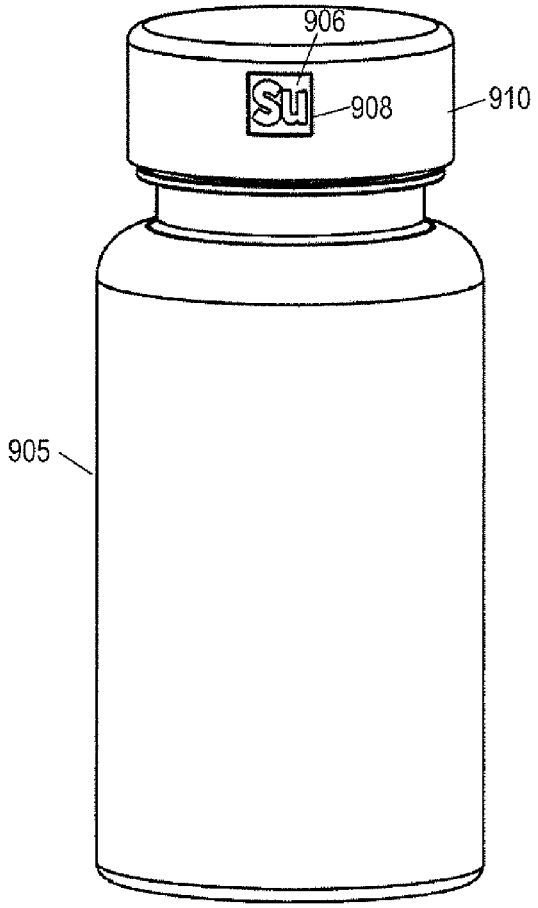
FIG. 9A show a perspective view of a third CDS implementation of the bottle with a dispensing schedule to which the current disclosure is directed.
Figure 9C:
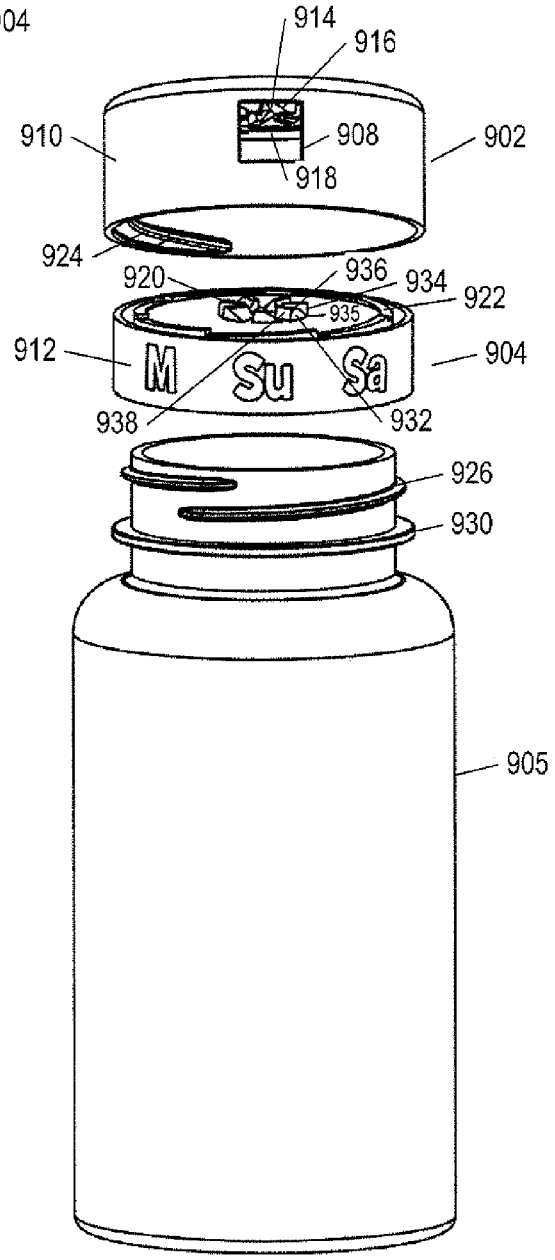
FIG. 9C shows an exploded view of the third CDS implementation shown in FIG. 9A.

FIG. 9A show a perspective view of a third CDS implementation of the bottle with a dispensing schedule to which the current disclosure is directed. FIG. 9B shows a perspective view of the schedule display of the third CDS implementation shown in FIG. 9A. FIG. 9C shows an exploded view of the third CDS implementation shown in FIG. 9A. In FIG. 9C, three components of the third CDS implementation, cap 902, schedule display 904, and threaded bottle 905, similar to the bottle shown in FIG. 1, are disassembled. Similar to the first CDS implementation, a single indication 906 is displayed to a user through an indication-display aperture 908 in the cap rim 910. In FIG. 9B, schedule display 904 is viewed from below. The schedule display 904 also includes a pair of raised tabs that form a grip 911 for rotating the schedule display with respect to the cap. In the CDS implementation shown in FIGS. 9A-C, schedule display 904 includes 7 indications uniformly spaced on the display surface 912 of the schedule display 904. The number of indications may vary in alternative implementations. Cap 902 includes an inner cap ratchet wheel 914 with 7 ratchet teeth, such as ratchet tooth 916, and an outer cap ratchet wheel 918 with 7 ratchet teeth. The cap ratchet teeth protrude downward, orthogonal to the plane of the disk-shaped cap and parallel to the cap rim 910. The inner cap ratchet wheel 914 and outer cap ratchet wheel 918 are complementary to inner schedule-display ratchet wheel 920 and outer schedule-display ratchet wheel 922, respectively. Both schedule-display ratchet wheels 920 and 922 include 7 ratchet teeth protruding upward to engage with the cap ratchet teeth.

When schedule display 904 is inserted into cap 902, the teeth of inner ratchet wheels 914 and 920 are fully meshed, fixing the cap with respect to the schedule display, while outer ratchet wheels 918 and 922 are vertically separated and not engaged. When the cap assembly is placed onto the bottle and rotated clockwise and as the cap threading 924 travels along the bottle threading 926, the sealing ring 928 makes contact with the bottle lip 930, creating friction between the schedule display and the bottle, which prevents the schedule display 904 from descending further as the cap 902 continues to descend. Because inner ratchet wheels 914 and 920 are positioned close to the center of the cap and sealing ring 928 is positioned along the perimeter of the schedule display, the friction between the bottle and the schedule display overcomes the friction between the cap and the schedule display. As a result, schedule display 904 is hindered from rotating with respect to the bottle while cap 902 continues to rotate around the schedule display.

As cap 902 rotates around the schedule display to move from one indication to the next, the teeth of inner ratchet wheels 914 and 920 slip past one another in the disengaged direction. Flexibility in the schedule display, as the cap assembly is forced down, allows schedule display to compress so that outer ratchet wheel 918 is drawn into outer ratchet wheel 922. When indication-display aperture 908 reaches the next sequential indication, the two outer ratchet wheels 918 and 922 engage to prevent further rotation of the cap relative to the schedule display. The teeth of the inner ratchet wheel 914 of the cap again interlock with the teeth of schedule-display inner ratchet wheel 920, with a relative advancement between the two ratchet wheels of one tooth. When the cap assembly is rotated counter-clockwise for removal, the interlock between cap inner ratchet wheel 914 and schedule-display inner ratchet wheel 920 compels the schedule display to rotate in cooperation with the cap so that the indication-display aperture 908 remains centered over the next indication. Outer ratchet wheels 918 and 922 return to their original disengaged positions.

In the CDS implementation shown in FIGS. 9A-C, the tapered side of each inner ratchet tooth, such as ratchet tooth 932, has a steep portion 934 near the base 935 and a shallow portion 936 near the top. As the cap rotates around the schedule display, the transition from the steep portion 934 to the shallow portion 936 of the slope reduces required torque force in order to encourage a user to continue to rotate the cap until a next indication is reached.

Similar to the engaging side 402 of the biasing catch 224 shown in the first CDS implementation, the engaging side 938 of ratchet tooth 932 is slanted towards the tapered side so that the inside angle between the engaging side 938 and the base 935 is acute. The slant reduces the distance that the inner ratchet wheel tips need to travel to pass one another so that the teeth reach their next position momentarily before indication-display aperture 908 is centered over a next indication.

Figure 10A:
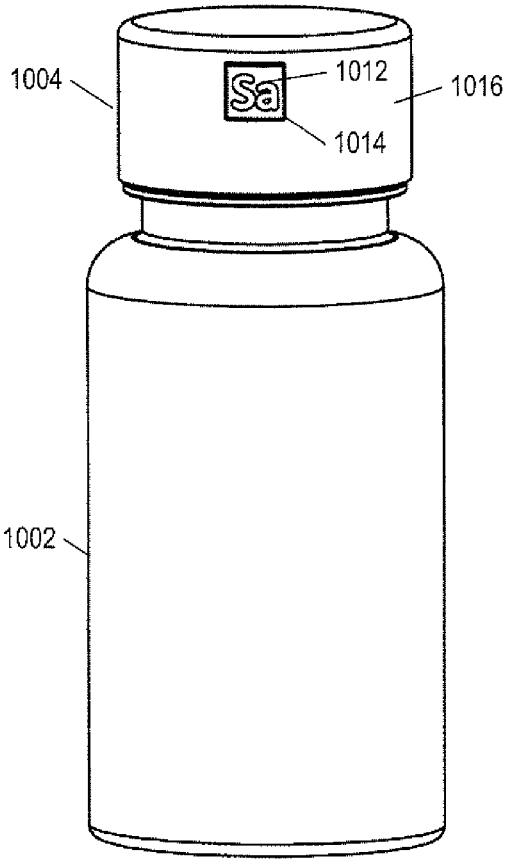
FIG. 10A shows a perspective view of a fourth CDS implementation.
Figure 10B:
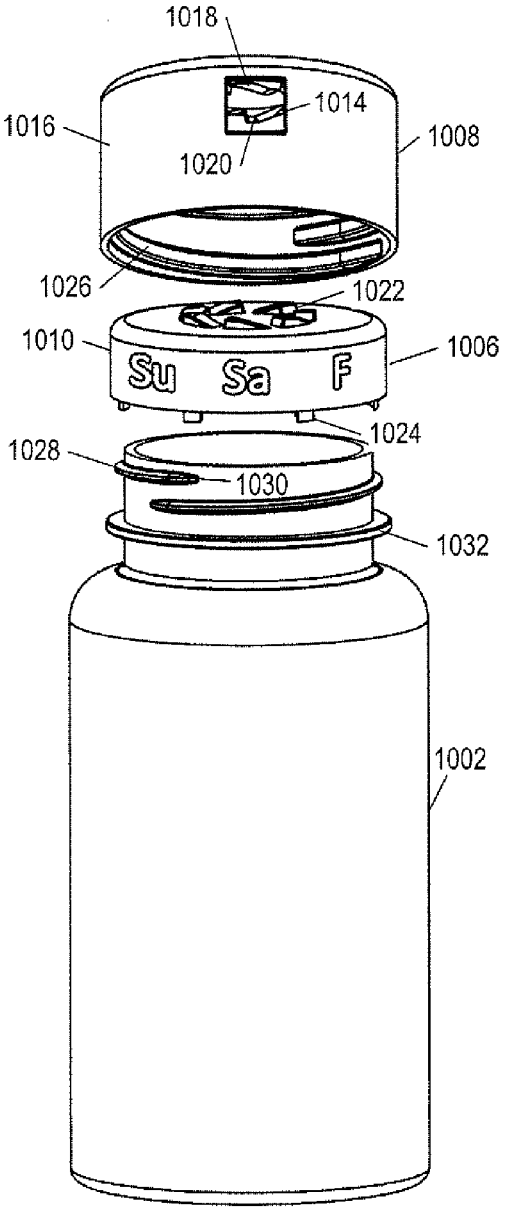
FIG. 10B shows an exploded view of the fourth CDS implementation shown in FIG. 10A.

FIG. 10A shows a perspective view of a fourth CDS implementation to which the current disclosure is directed. FIG. 10B shows an exploded view of the fourth CDS implementation shown in FIG. 10A. Similar to the third CDS implementation shown in FIGS. 9A-C, the CDS implementation shown in FIGS. 10A-B consists of a bottle 1002, similar to the bottle 102 in the previous CDS implementations, and a cap assembly 1004 comprising a schedule display 1006 inserted into a cap 1008. Similar to the third CDS implementation shown in FIGS. 9A-C, the schedule display 1006 includes 7 indications uniformly spaced on the display surface or rim 1010 of schedule display 1006, with a single indication 1012 displayed to a user through an indication-display aperture 1014 in the cap rim 1016. Similar to the third CDS implementation shown in FIGS. 9A-C, cap 1008 includes a cap ratchet wheel 1018 with 7 ratchet teeth, such as ratchet tooth 1020. The cap ratchet wheel 1018 is complementary to a ratchet wheel 1022 on the disk-shaped surface of the schedule display 1006. At the base of the schedule-display rim, seven lugs, such as lug 1024, uniformly spaced along the bottom edge of the schedule-display rim 1010, protrude inward in radial directions from the inner surface of the schedule-display rim.

When schedule display 1006 is inserted into cap 1008, the teeth of the cap ratchet wheel 1018 and the schedule-display ratchet wheel 1022 are fully meshed, similar to the inner ratchet wheels 914 and 920 in the third CDS implementation. When the cap assembly 1004 is placed onto the bottle and rotated clockwise, cap thread 1026 screws into bottle threading 1028. Lugs 1024 are rotationally positioned along the schedule-display rim 1010 with respect to bottle threading 1028 so that at least one of the lugs rotates into thread start 1030 at a predetermined point during cap rotation and the schedule display is blocked from further rotating relative to the bottle. As the cap continues to rotate with respect to the schedule display, indication-display aperture 1014 moves from one indication to the next while cap ratchet wheel 1018 rotates relative to schedule-display ratchet wheel 1022 in the disengaged direction so that the ratchet teeth slip past one another. The process continues until the cap assembly 1004 is tightly screwed on to the bottle 1002. Controlling where the cap 1008 stops rotating along the bottle threading can be accomplished through the length of cap thread 1026 and/or the height of the cap rim, which determines when the cap collides with bottle stop annulus 1032.

When the cap assembly is rotated counter-clockwise for removal, ratchet wheels 1018 and 1022 remain interlocked, compelling schedule display 1006 to rotate in cooperation with cap 1008, so that indication-display aperture 1014 remains centered over the next indication until the cap assembly is re-affixed to the bottle to begin a next mounting cycle.

Figure 11C:
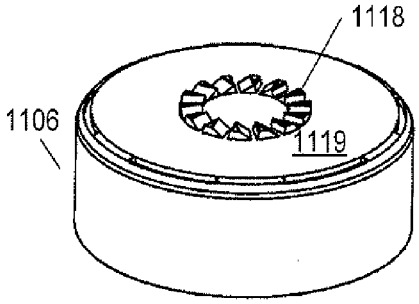
FIG. 11C is an alternative perspective view of the schedule display shown in FIG. 11B.
Figure 11A:
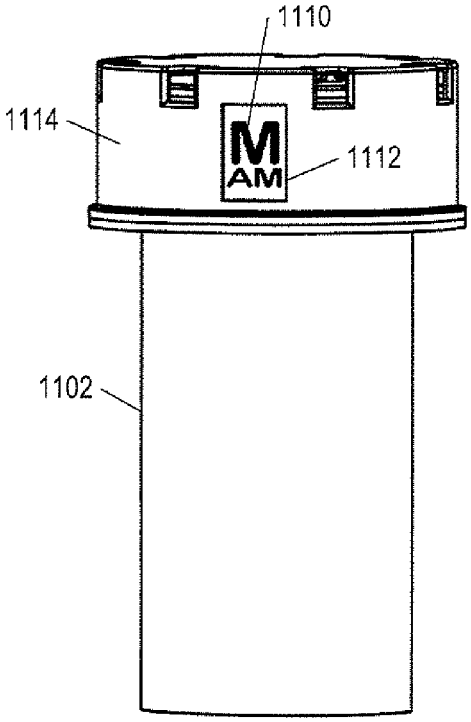
FIG. 11A shows a perspective view of a fifth CDS implementation.
Figure 11B:
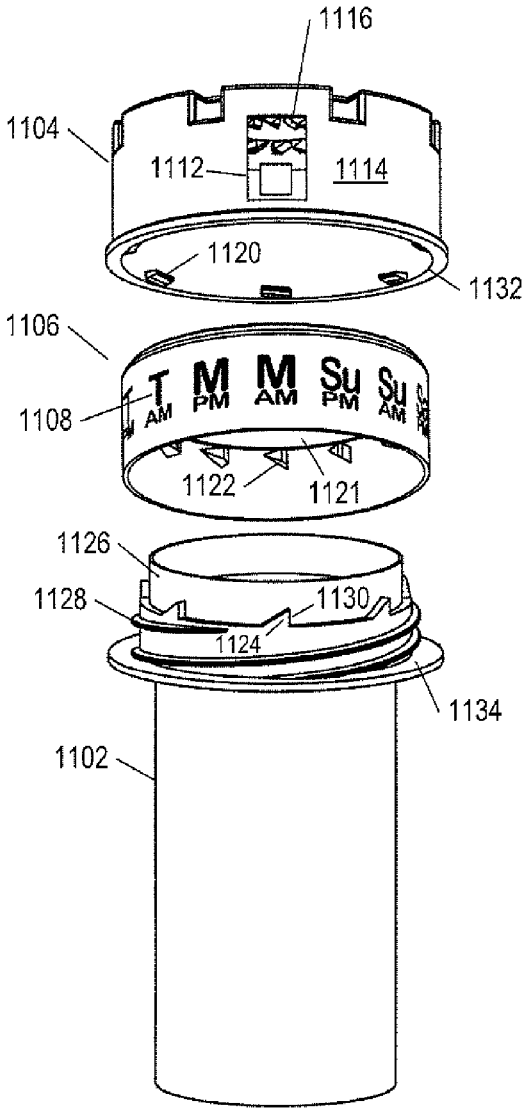
FIG. 11B shows an exploded view of the fifth CDS implementation shown in FIG. 11A.

FIG. 11A shows a perspective view of a fifth CDS implementation. FIG. 11B shows an exploded view of the fifth CDS implementation shown in FIG. 11A. FIG. 11C is an alternative perspective view of the schedule display shown in FIG. 11B. The CDS implementation shown in FIGS. 11A-C resembles the fourth CDS implementation shown in FIGS. 10A-B, with additional features added. The fifth CDS implementation includes a bottle 1102 and a cap 1104 with a schedule display 1106. In FIG. 11C, the schedule display is viewed from top. The schedule display 1106 includes 14 indications uniformly spaced on the display surface or rim 1108 of schedule display 1106, with a single indication 1110 displayed to a user through an indication-display aperture 1112 in the cap rim 1114. Similar to the fourth CDS implementation shown in FIGS. 10A-B, cap 1104 includes a cap ratchet wheel 1116 with 14 ratchet teeth complementary with the 14 ratchet teeth of a schedule-display ratchet wheel 1118 on the disk-shaped surface 1119 of schedule display 1106. The CDS implementation shown in FIGS. 11-C also includes 7 lugs, such as lug 1120, uniformly spaced along the inside of the bottom edge of the cap rim 1114.

In addition to the lugs 1120 and ratchet wheels 1116 and 1118, the cap assembly also includes 14 schedule-display biasing features, such as schedule-display biasing feature 1122, that extend inward, in radial directions, from the inner surface of the schedule-display rim 1108 and that engage with bottle biasing features, such as bottle biasing feature 1124 that are positioned along the bottom edge of bottle lip 1126. Schedule-display biasing features 1122 are evenly spaced around schedule display 1106 in increments of 360 degrees divided by the number of indications. The bottle biasing feature 1124 may be one or more triangle-shaped extensions, as shown in FIG. 11B, as well as a variety of protrusions or indentations that can complementarily interoperate with the schedule-display biasing features to prevent the schedule display from rotating around the bottle. The CDS implementation shown in FIG. 11B has 7 bottle biasing features. In other CDS implementations, one bottle biasing feature may be used. When more than one bottle biasing features are used, two successive bottle biasing features are spaced in increments that are integer multiple of the degrees of separation between two successive schedule-display biasing features. The location of the bottle biasing features may also be altered. The bottle biasing features may be located on the inside or outside of bottle lip 1126 or on the top or bottom of the bottle lip.

When schedule display 1106 is pushed into cap 1104, the teeth of ratchet wheels 1116 and 1118 are fully meshed to center indication-display aperture 1112 over a first indication. Lugs 1120 snap the schedule display into position and hold the schedule display within the cap. When the cap assembly is placed to the bottle and rotated clockwise and as cap lugs 1120 travel along bottle threading 1128, schedule-display biasing feature 1122 collides with the engaging side 1130 of bottle biasing feature 1124, fixing the position of schedule display 1106 with respect to the bottle 1102. As cap 1104 continues to rotate around schedule display 1106, the teeth of cap ratchet wheel 1116 slip past the teeth of schedule-display ratchet wheel 1118 in the disengaged direction and indication-display aperture 1112 advances to the next indication. The lower annular inner skirt 1121 of schedule display 1108 presses into bottle lip 1126 to form an airtight and water impermeable seal and cap base 1132 reaches bottle stop annulus, preventing further rotation.

When the cap assembly is rotated counter-clockwise for removal, cap ratchet wheel 1116 is interlocked with schedule-display ratchet wheel 1118, fixing the position of schedule display 1106 with respect to cap 1104, so that indication-display aperture 1112 remains centered over the next indication.

As previously described with reference to the first CDS implementation, the number, dimension, and placement of various components of the cap 1104, the schedule display 1106, and the bottle 1102 need to be coordinated to ensure that the device makes precisely one indication in each mounting cycle of the cap onto the bottle and that each of the relevant components is re-aligned when the device is ready for the next mounting cycle. Schedule-display biasing features 1122 reach bottle biasing features 1124 when the remaining rotational degree of the cap is equal to 360 degrees divided by the number of indications. The number of indications and schedule-display biasing features are equal and are an integer multiple of the number of cap lugs so that, in each mounting cycle, after the cap rotates the distance from one indication to the next, cap lugs are re-aligned with schedule-display biasing features. The number of schedule-display biasing features is also an integer multiple of the number of bottle biasing features. The ratio of one ratchet tooth to one indication is preserved in the CDS implementation shown in FIGS. 11A-C. However, in other CDS implementations, this ratio may be altered.

Similar to the first CDS implementation shown in FIGS. 1-7, the mechanism utilized by the CDS implementation shown in FIGS. 11A-C is designed so that the dimensions and the coordinated number of biasing features, ratchet-wheel teeth, and indications can be calibrated to accommodate other daily prescription schedules. For example, another CDS implementation designed for three doses per day has 7 cap lugs and 7 bottle biasing features, but has 21 indications, 21 schedule-display biasing features, 21 cap ratchet teeth, and 21 schedule-display ratchet teeth, one for each of the three doses for each day of the week. When 21 indications are used, schedule-display biasing features need to be located in a higher vertical positions relative to the cap compared to those of schedule displays with 14 indications, so that the schedule-display biasing features interact with bottle biasing features at a point in cap rotation appropriate for a 21-indication container.

In the CDS implementation shown in FIGS. 11A-C, the cap 1104 with the schedule display 1106 is shown with the bottle 1102 having a multiple continuous threads. However, the same cap and schedule display may also work with bottles with a larger or smaller number of threads. For example, when a bottle with three threads is used, the three threads are spaced in integer multiples of the degrees of separation between two successive cap lugs 1120, which are equal to the integer multiples of 360 degrees divided by the number of cap lugs.

Figure 12A:
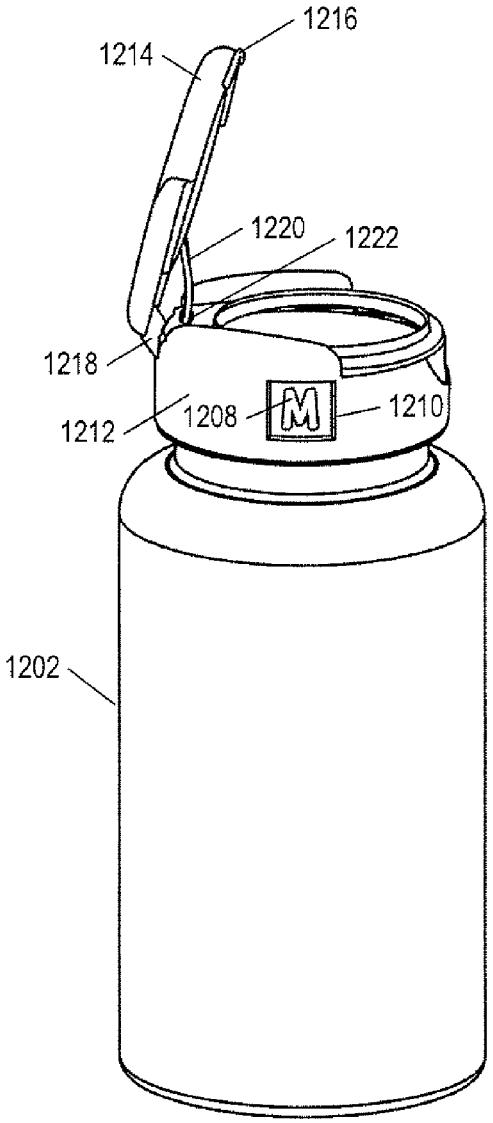
FIG. 12A shows a perspective view of a sixth CDS implementation of the bottle with a dispensing schedule to which the current disclosure is directed.
Figure 12B:
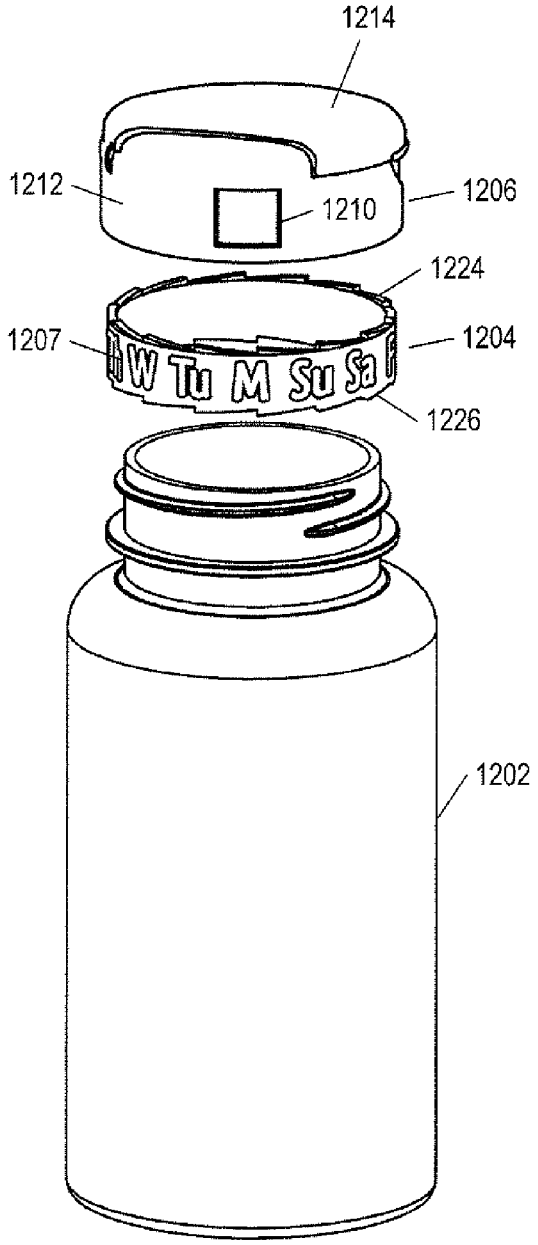
FIG. 12B shows an exploded view of the sixth CDS implementation shown in FIG. 12A.

FIG. 12A shows a perspective view of a sixth CDS implementation of the bottle with a dispensing schedule to which the current disclosure is directed. FIG. 12B shows an exploded view of the sixth CDS implementation shown in FIG. 12A. The CDS implementation shown in FIGS. 12A-B consists of a threaded bottle 1202, similar to the threaded bottle shown in the first CDS implementation, and a cap assembly comprising of cap 1206 and internal schedule display 1204. The schedule display 1204 shown in FIG. 12B includes 14 indications uniformly spaced on the schedule-display rim 1206, with a single indication 1208 displayed to a user through an indication-display aperture 1210 in the cap rim 1212. The cap includes additional features, including a lid 1214 that can be flipped open via a grip 1216, a hinge 1218 connecting the lid 1214 to cap rim 1212, and an actuator 1220 that leads from the underside of lid 1214 through a hole 1222 where the actuator is channeled to the top of an upper ratchet rim 1224 on the schedule display 1204. The upper ratchet rim 1224 has the same number of ratchet teeth as the number of indications. The schedule display may include an optional lower ratchet rim 1226, or other mechanisms along the bottom edge of schedule display 1204, to increase friction between the schedule display 1204 and the cap 1206 so that the schedule display 1204 does not rotate unintentionally with respect to the cap 1206. When a lower ratchet rim 1226 is used, the cap 1204 includes a complementary feature, such as a ratchet wheel, pawl, divot, or variety of other features, to receive the lower ratchet rim 1226 of schedule display 1204.

Each time lid 1214 is flipped open, actuator 1220 is pulled with the lid and retracts over upper ratchet wheel 1224 in the disengaged direction. When lid 1214 is closed, actuator 1220 advances and catches on the engaging side of one of the ratchet teeth, compelling the schedule display 1204 to rotate from one indication to the next to make an indication.

CDS implementations provide mechanical advantages over currently-available devices. CDS implementations function automatically and accurately, preventing human error. CDS implementations can be effectively calibrated to any number of schedule elements that are a multiple of seven days of the week and can therefore conform to the most common prescription schedules, although the number of schedule elements may be other than multiples of seven. CDS implementations also provide a means for manual adjustment to a correct indication. This is particularly helpful for presetting the indicator to a correct day and time of the first dosage. CDS implementations include a commonly-accepted form of childproofing, are airtight, and do not require a non-standard method of applying the cap to the bottle. CDS implementations function without overly stressing any of the three components, namely the cap, the schedule display, and the bottle, facilitating the reduction and/or elimination of wear. Therefore, CDS implementations achieve a higher level of durability for safe dispensing of medications.

The mechanism utilized by certain CDS implementations does not require conscious effort or control from a person for it to make accurate indications. And, the displayed schedule element is not advanced unless the cap is successfully affixed to the bottle, thus eliminating potential human error. Furthermore, the displayed schedule element advances one schedule element at a time and, at the end of each cycle, is automatically realigned for the next cycle.

Each of the components of the example CDS implementation can be rapidly mass-manufactured with simple molds. Each of the example CDS implementations can be manufactured as just three pieces and can be made of the same materials from which common, commercially-available pill bottles are manufactured. Additionally, the indicating mechanism utilized by the current CDS implementations is designed to function properly despite potential variations in manufacturing accuracy.

Childproofing can be added to CDS implementations in a variety of forms. An outer cap can be added to the cap assembly so that a set of ratchet teeth between the outer cap and the cap assembly engage when rotated in a clockwise direction and release when rotated in a counter-clockwise direction. When the outer cap is affixed to the cap assembly, the ratchet teeth engage to compel the cap assembly to rotate in cooperation with the outer cap. When the cap assembly is rotated counterclockwise for removal, the ratchet teeth of the outer cap rotate relative to the ratchet teeth of the cap assembly and slip over one another unless the outer cap is pushed hard enough into the cap assembly to increase friction between the complementary ratchet teeth overcomes friction in the threads created when the cap is tightened. Alternatively, an extension in the lip of the cap can be provided with hooks that slide over the stop annulus of the bottle when the cap assembly is placed onto the bottle. When an attempt is made to remove the cap, the hooks engage the underside of the stop annulus, preventing the cap from ascending the bottle threads. Squeezing the cap between the hooks temporarily deforms the cap, flattening the portion where squeezed but widening the portion where the hooks reach over the stop annulus so that the hooks release from the bottle and the cap assembly can be removed. Similarly, one or two barbs can be added around the outside of the neck of the bottle and complementary features can be added on the cap, which engage the barbs, when the cap is screwed onto the bottle, to prevent counterclockwise rotation. Squeezing the cap between the added features would deform the cap and release the cap features from the barbs on the bottle. Yet another method is to add a flexible tab to the neck of the bottle with a catch feature and a complementary feature on the cap which engages with the catch feature when the cap is place onto the bottle. To remove the cap, a user depresses the tab, releasing the catch feature. And yet another method is to add a notch to the underside of the bottle threading for the cap thread or lugs to slide once the cap is screwed on, preventing the cap from rotating in the opposite direction for removal. To remove the cap, a user presses the cap down to free the lug or thread from the notch before rotating the cap.

Although the current disclosure has been described in terms of particular CDS implementations, it is not intended that the current disclosure be limited to these CDS implementations. Modifications will be apparent to those skilled in the art. For example, as mentioned above, the number of catch teeth, ramp features, biasing features, biasing catches, and other biasing means can be varied, in alternative CDS implementations, in order to provide different numbers of schedule elements. In alternative CDS implementations, different biasing means may be used with same or different shapes or locations. In alternative CDS implementations, an alternative mechanism or feature for rotating the schedule display with respect to the cap in order to set an initial schedule display element may be used instead of grip 414, discussed above with reference to FIG. 4B. In certain CDS implementations, features complementary to an initial-schedule-element setting tool can be used to ensure that the schedule is set by a pharmacist or other healthcare provider. As discussed above, the schedule elements contain various different types of information related to times, days of the week, dates, and other such characteristics that specify when a next dose is to be administered. The schedule elements may be molded, embossed, printed, or otherwise placed onto the exterior wall of the schedule-display rim. The dimensions and shapes of each of the component features may vary with varying CDS implementations provided that they interoperate together as described above. The cap, schedule display, and bottle may be manufactured from any of many well-known polymeric materials, and can have essentially arbitrary colors, transparencies, rigidity and flexibility, and other such characteristics and parameters. The bottle and cap may contain additional features, including additional information displays, features for facilitating attachment of additional information by pharmacies and pharmacists, and other features.

It is appreciated that the previous description of the disclosed CDS implementations is provided to enable any person skilled in the art to make or use the present disclosure. Various modifications to these CDS implementations will be readily apparent to those skilled in the art, and the generic principles defined herein may be applied to other CDS implementations without departing from the spirit or scope of the disclosure. Thus, the present disclosure is not intended to be limited to the CDS implementations shown herein but is to be accorded the widest scope consistent with the principles and novel features disclosed herein.

The invention claimed is:

1. A container with a dispensing schedule, the container consisting of:
- a bottle with a threaded neck; and
- a cap assembly that includes
  - a threaded cap with an indication-display aperture, and
  - a schedule display mounted within the threaded cap that
    - includes a circularly ordered set of a first number of schedule elements, each schedule element including an indication,
    - interoperates with the threaded cap and bottle to advance the indication-display aperture to a next indication within a next schedule element of the schedule display when the cap assembly is screwed onto the bottle, and
    - interoperates with the threaded cap and bottle to prevent indication advancement when the cap assembly is unscrewed and removed from the bottle;
- wherein the schedule display includes a number of slits that facilitate insertion of the schedule display into the cap.

2. A container with a dispensing schedule, the container consisting of:
- a bottle with a threaded neck; and
- a cap assembly that includes
  - a threaded cap with an indication-display aperture, and
  - a schedule display mounted within the threaded cap that
    - includes a circularly ordered set of a first number of schedule elements, each schedule element including an indication,
    - interoperates with the threaded cap and bottle to advance the indication-display aperture to a next indication within a next schedule element of the schedule display when the cap assembly is screwed onto the bottle, and
    - interoperates with the threaded cap and bottle to prevent indication advancement when the cap assembly is unscrewed and removed from the bottle;
- wherein the schedule display comprises:
  - a disk-shaped top;
  - a sealing ring with a lower edge complementary to a lip of the bottle; and
  - a schedule-display rim having a shape of a conical section that includes the circularly ordered set of schedule elements.

3. The container with a dispensing schedule of claim 2
- wherein the schedule display further includes a centering pin that cooperate with a complementary centering feature on an underside of a top of the cap and inverted double-ramp features along the lower portion of the schedule-display rim that cooperate with cap double-ramp features on an inner side of a cap rim to align schedule elements with the indication-display aperture when the schedule display is inserted into the cap.

4. A container with a dispensing schedule, the container consisting of:
- a bottle with a threaded neck; and
- a cap assembly that includes
  - a threaded cap with an indication-display aperture, and
  - a schedule display mounted within the threaded cap that
    - includes a circularly ordered set of a first number of schedule elements, each schedule element including an indication,
    - interoperates with the threaded cap and bottle to advance the indication-display aperture to a next indication within a next schedule element of the schedule display when the cap assembly is screwed onto the bottle, and
    - interoperates with the threaded cap and bottle to prevent indication advancement when the cap assembly is unscrewed and removed from the bottle;
- wherein the schedule display includes a second number of evenly spaced biasing catch features each complementary to one or more biasing features in the cap; and wherein the schedule display includes a third number of evenly spaced schedule-display catch teeth complementary to one or more cap catch teeth and a fourth number of evenly spaced inverted ramp features complementary to one or more cap ramp features.

5. A container with a dispensing schedule, the container comprising:

a bottle with a threaded neck; and a cap assembly that includes a threaded cap with an indication-display aperture, one or more cap catch teeth, one or more cap ramp features, and one or more biasing features, and a schedule display mounted within the threaded cap that includes a circularly ordered set of a first number of schedule elements, each schedule element including an indication, a second number of evenly spaced schedule-display catch teeth, a third number of evenly spaced inverted ramp features, and a fourth number of evenly spaced biasing catch features, interoperates with the threaded cap and bottle to advance the indication-display aperture to a next indication within a next schedule element of the schedule display when the cap assembly is screwed onto the bottle, and interoperates with the threaded cap and bottle to prevent indication advancement when the cap assembly is unscrewed and removed from the bottle.

6. The container with a dispensing schedule of claim 5 wherein the cap, the schedule display, and the bottle are each single-piece components; and wherein the schedule display includes one or more manual-manipulation features that allow for manual indication advancement.

7. The container with a dispensing schedule of claim 5 wherein the second number of evenly spaced schedule-display catch teeth are each complementary to the one or more cap catch teeth;

wherein the third number of evenly spaced inverted ramp features are each complementary to the one or more cap ramp features;

wherein the fourth number of evenly spaced biasing catch features are each complementary to the one or more biasing features in the cap;

wherein the fourth number of biasing catch features is equal to the first number of schedule elements; and wherein, when the indication-display aperture advances to a next indication within a next schedule element of the schedule display as the cap assembly is screwed onto the bottle, the cap rotates by an angle with respect to the schedule display equal to the angular displacement of two adjacent schedule-display biasing catch features.

8. A container with a dispensing schedule, the container consisting essentially of:

a single-piece bottle with a threaded neck; and a cap assembly that includes a single-piece threaded cap with an indication-display aperture, and a single-piece schedule display mounted within the threaded cap that includes a disk-shaped top, a sealing ring with a lower edge complementary to a lip of the bottle, a schedule-display rim having a shape of a conical section that includes a circularly ordered set of a first number of schedule elements, one or more manual-manipulation features that allow for manual indication advancement, and a second number of evenly spaced biasing catch features, each complementary to the one or more biasing features in the cap.

9. The container with a dispensing schedule of claim 8 wherein the schedule display interoperates with the threaded cap and bottle to advance the indication-display aperture to a next indication within a next schedule element of the schedule display when the cap assembly is screwed onto the bottle; and wherein the schedule display interoperates with the threaded cap and bottle to prevent indication advancement when the cap assembly is unscrewed and removed from the bottle.

* * * * *